US010632738B2

(12) United States Patent
Tobe et al.

(10) Patent No.: US 10,632,738 B2
(45) Date of Patent: Apr. 28, 2020

(54) LIQUID TRANSFER APPARATUS

(71) Applicant: KOMORI CORPORATION, Tokyo (JP)

(72) Inventors: Kenji Tobe, Tsukuba (JP); Hiromichi Shimokawa, Tsukuba (JP); Tomoya Miyoshi, Tsukuba (JP); Masaya Tateno, Tsukuba (JP); Atsushi Ohnami, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 39 days.

(21) Appl. No.: 15/851,140

(22) Filed: Dec. 21, 2017

(65) Prior Publication Data

US 2018/0178504 A1 Jun. 28, 2018

(30) Foreign Application Priority Data

Dec. 22, 2016 (JP) ..... 2016-248566
May 1, 2017 (JP) ..... 2017-091237

(51) Int. Cl.
*B41F 31/14* (2006.01)
*B41F 13/42* (2006.01)
(Continued)

(52) U.S. Cl.
CPC ..... *B41F 31/14* (2013.01); *B41F 13/42* (2013.01); *B41F 31/027* (2013.01); *B41F 31/26* (2013.01);
(Continued)

(58) Field of Classification Search
CPC ..... B41F 31/027; B41F 31/14; B41F 31/301; B41F 31/26; B41F 13/42; B41F 13/0024
See application file for complete search history.

(56) References Cited

U.S. PATENT DOCUMENTS 1,024,473 A 4/1912 Firm
5,081,928 A * 1/1992 Harrison ..... B41F 31/027 101/351.4
(Continued)

FOREIGN PATENT DOCUMENTS

DE 11 40 205 B 11/1962
DE 197 53 136 A1 6/1999
(Continued)

OTHER PUBLICATIONS

Extended European Seach Report dated Apr. 20, 2018 issued in the corresponding EP Application No. 17206700.1.
(Continued)

*Primary Examiner* — Judy Nguyen
*Assistant Examiner* — Quang X Nguyen
(74) *Attorney, Agent, or Firm* — Birch, Stewart, Kolasch & Birch, LLP

(57) ABSTRACT

A liquid transfer apparatus includes: rollers configured to transfer supplied liquid to a blanket cylinder; a roller holding device configured to detachably hold the rollers and perform a rotating operation to move any one of the rollers to a predetermined position facing the blanket cylinder; and a contact-separation unit configured to bring the roller held by the roller holding device and disposed at the predetermined position into and out of contact with the blanket cylinder.

6 Claims, 16 Drawing Sheets

(51) Int. Cl.

| | |
|---|---|
| ***B41F 31/30*** | (2006.01) |
| ***B41F 31/26*** | (2006.01) |
| ***B41F 31/02*** | (2006.01) |
| *B41F 13/00* | (2006.01) |

(52) U.S. Cl.
CPC ..... *B41F 31/301* (2013.01); *B41F 31/302* (2013.01); *B41F 13/0024* (2013.01)

(56) References Cited

U.S. PATENT DOCUMENTS 5,112,208 A * 5/1992 Voth ..... A21C 3/02 264/175
5,154,602 A * 10/1992 Harrison ..... B41F 5/24 101/351.3
5,938,080 A * 8/1999 Haaser ..... B01F 13/1058 222/144
2003/0200883 A1* 10/2003 Bitterich ..... B41F 31/027 101/216
2006/0272526 A1* 12/2006 Chen ..... B41F 31/027 101/348
2009/0078138 A1* 3/2009 Masuch ..... B41F 13/30 101/248

FOREIGN PATENT DOCUMENTS

| | | | |
|---|---|---|---|
| EP | 0 468 655 | A1 | 1/1992 |
| GB | 2245527 | A | 1/1992 |
| JP | 2003-311931 | A | 11/2003 |

OTHER PUBLICATIONS

Chinese Office Action and Search Report for Chinese Application No. 201711363819.4, dated Oct. 31, 2019, with partial English translation.

* cited by examiner

LIQUID TRANSFER APPARATUS

TECHNICAL FIELD

The present invention relates to a liquid transfer apparatus in a printing press.

BACKGROUND ART

A liquid transfer apparatus which transfers liquid (for example, coating liquid such as varnish) to a print medium (sheet or web) includes an impression cylinder configured to convey the print medium, a coater cylinder (blanket cylinder) in contact with the impression cylinder, and an anilox roller (engraved roller) in contact with the coater cylinder. The liquid supplied to the anilox roller by a liquid supplying device (chamber device) is transferred to the print medium on the impression cylinder via the coater cylinder.

Various types of anilox rollers are selectively used for the transfer of the liquid to the print medium by the liquid transfer apparatus, depending on the content of printing performed on the print medium. The various types of anilox rollers vary in a cell shape, a cell volume, and the like of engraving formed on a surface of the anilox roller. Accordingly, when the printing content is changed in a printing apparatus, the anilox roller sometimes has to be changed (switched) in the liquid transfer apparatus depending on the changed printing content. Examples of the technique for switching the anilox roller in the liquid transfer apparatus as described above include one described in Patent Literature 1.

CITATION LIST

Patent Literature

{Patent Literature 1} Japanese Patent Application Publication No. 2003-311931

SUMMARY OF INVENTION

Technical Problem

In the technique described in Patent Literature 1, a revolver magazine which can hold four screen rollers is provided above a cylinder (plate cylinder or blanket cylinder). The screen roller to be used is moved to a specified position by rotating the revolver magazine and the worker moves the screen roller disposed at the specified position to an active position (print position) in contact with the cylinder, by using a crane.

However, in the technique described in Patent Literature 1, the worker has to perform work of switching the roller (work of moving the roller to the print position) by using the crane in a small space between units in the printing press. The work of switching the roller by using the crane in such a small space between units is poor in workability and takes time.

Moreover, since the roller is moved (conveyed) by the crane in the small space between units, the roller may come into contact with peripheral members around the roller. Such contact between the roller and the peripheral members may damage the roller or the peripheral members.

The present invention has been made in view of the aforementioned problems and an object is to facilitate switching of a roller in a liquid transfer apparatus.

Solution to Problem

A first aspect of the present invention for solving the aforementioned problems provides a liquid transfer apparatus characterized in that the liquid transfer apparatus includes: rollers configured to transfer supplied liquid to a blanket cylinder; a roller holding device configured to detachably hold the rollers and perform a rotating operation to move any one of the rollers to a predetermined position facing the blanket cylinder; and a contact-separation unit configured to bring the roller held by the roller holding device and disposed at the predetermined position into and out of contact with the blanket cylinder.

A second aspect of the present invention for solving the aforementioned problem provides the liquid transfer apparatus according to the first aspect, characterized in that the liquid transfer apparatus includes an alignment unit configured to determine positions of the rollers relative to the roller holding device.

A third aspect of the present invention for solving the aforementioned problem provides the liquid transfer apparatus according to the first or second aspect, characterized in that the liquid transfer apparatus includes a position fixation unit configured to fix a position of the roller held by the roller holding device and disposed at the predetermined position.

A fourth aspect of the present invention for solving the aforementioned problem provides the liquid transfer apparatus according to any one of the first to third aspects, characterized in that the liquid transfer apparatus includes a printing pressure adjustment unit configured to adjust printing pressure between the blanket cylinder and each of the rollers being at the predetermined position.

Advantageous Effects of Invention

In the liquid transfer apparatus according to the first aspect, a worker does not have to perform work of switching the roller (work of moving the roller to a print position) by using a crane in a small space between units in a printing press and can easily perform the switching of the roller in the liquid transfer apparatus. Accordingly, there is no risk of bringing the roller into contact with peripheral members around the roller and damaging the roller or the peripheral members.

In the liquid transfer apparatus according to the second aspect, each of the rollers held by the roller holding device can be moved to any position (phase) by the rotating operation of the roller holding device.

In the liquid transfer apparatus according to the third aspect, the roller can be brought into and out of contact with the blanket cylinder at the same position every time.

In the liquid transfer apparatus according to the fourth aspect, a state of the liquid to be transferred can be adjusted.

DESCRIPTION OF EMBODIMENTS

An embodiment of a liquid transfer apparatus according to the present invention is described below in detail with reference to the attached drawings. Note that the following embodiment is an embodiment in which the liquid transfer apparatus according to the present invention is employed as a coating apparatus in a printing press. The present invention is not limited to the following embodiment and various changes can be made within a scope not departing from the spirit of the present invention as a matter of course.

{Embodiment 1}

A configuration of the coating apparatus according to the embodiment is described with reference to FIGS. 1 to 10.

Figure 1:
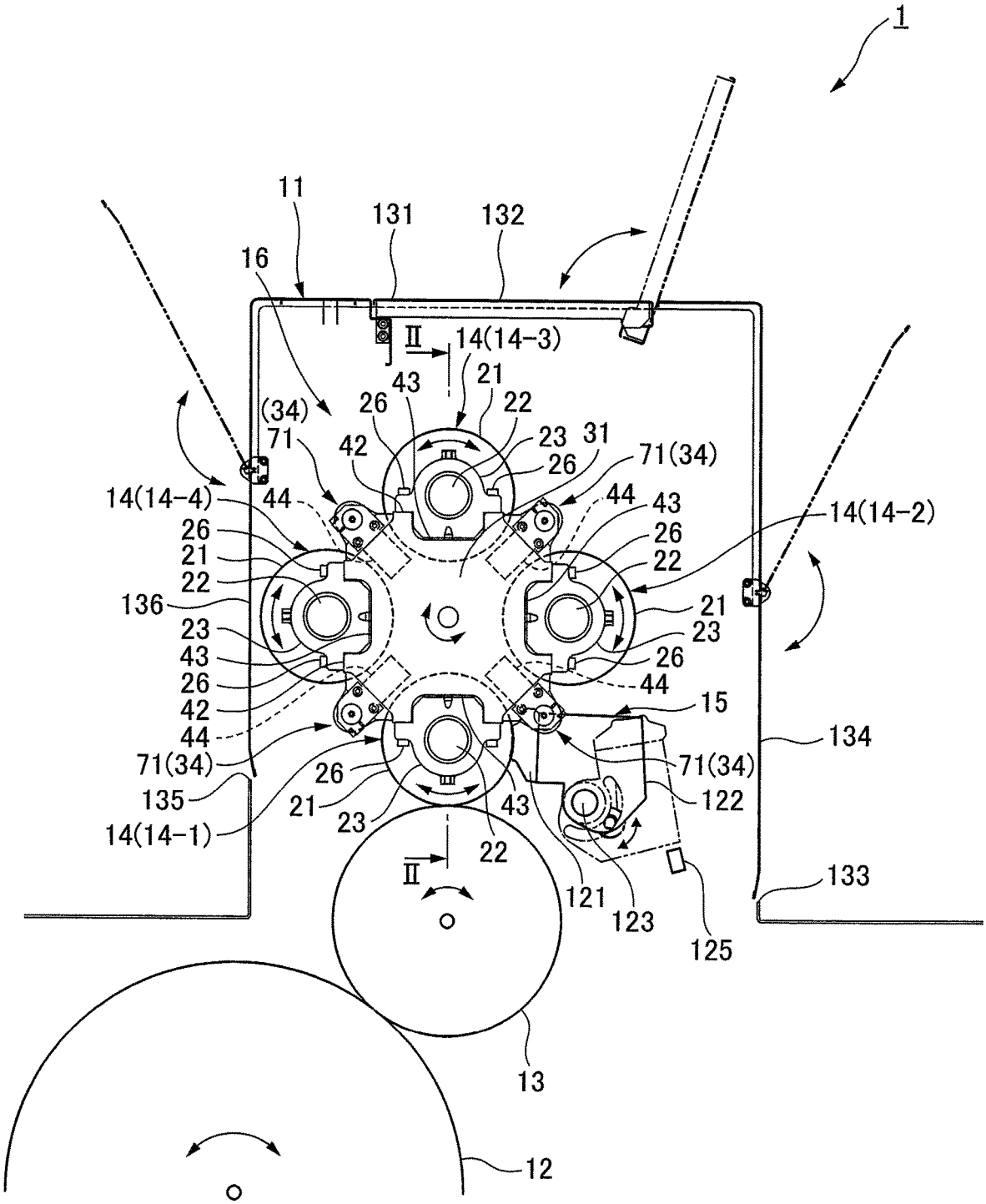
FIG. 1 is an explanatory view illustrating a configuration of a liquid transfer apparatus according to Embodiment 1.

As illustrated in FIG. 1, the coating apparatus (liquid transfer apparatus) 1 is provided with a housing 11 which is an outer shell of the coating apparatus 1. In the housing 11, there are provided an impression cylinder 12 capable of holding a sheet (having a not-illustrated sheet holding device), a coater cylinder (blanket cylinder) 13 being in contact with the impression cylinder 12, and anilox rollers (engraved cylinders, rollers) 14 arranged above the coater cylinder 13 in the vertical direction and configured to come into contact with the coater cylinder 13. In this embodiment, the impression cylinder 12 is a cylinder which conveys a sheet supplied from a not-illustrated sheet feeding device (or a printing apparatus or the like) by holding the sheet while being rotationally driven.

Moreover, the coating apparatus 1 is provided with a chamber device (liquid supply device) 15 capable of supplying liquid (for example, coating liquid such as varnish) to the anilox roller 14 in contact with the coater cylinder 13. In the coating apparatus 1, when the sheet is conveyed on the impression cylinder 12, the coating liquid supplied to the anilox roller 14 by the chamber device 15 is transferred (applied as coating) to a surface of the sheet via the coater cylinder 13.

Furthermore, the coating apparatus 1 is provided with an anilox roller switching device 16. The anilox roller switching device 16 holds multiple (four in the embodiment) anilox rollers 14 and can move one of the multiple anilox rollers 14 to a predetermined position (transfer operation position) facing the coater cylinder 13 to bring the one anilox roller 14 into and out of contact with the coater cylinder 13 (move the anilox roller 14 to a contact position and a separated position).

Figure 2:
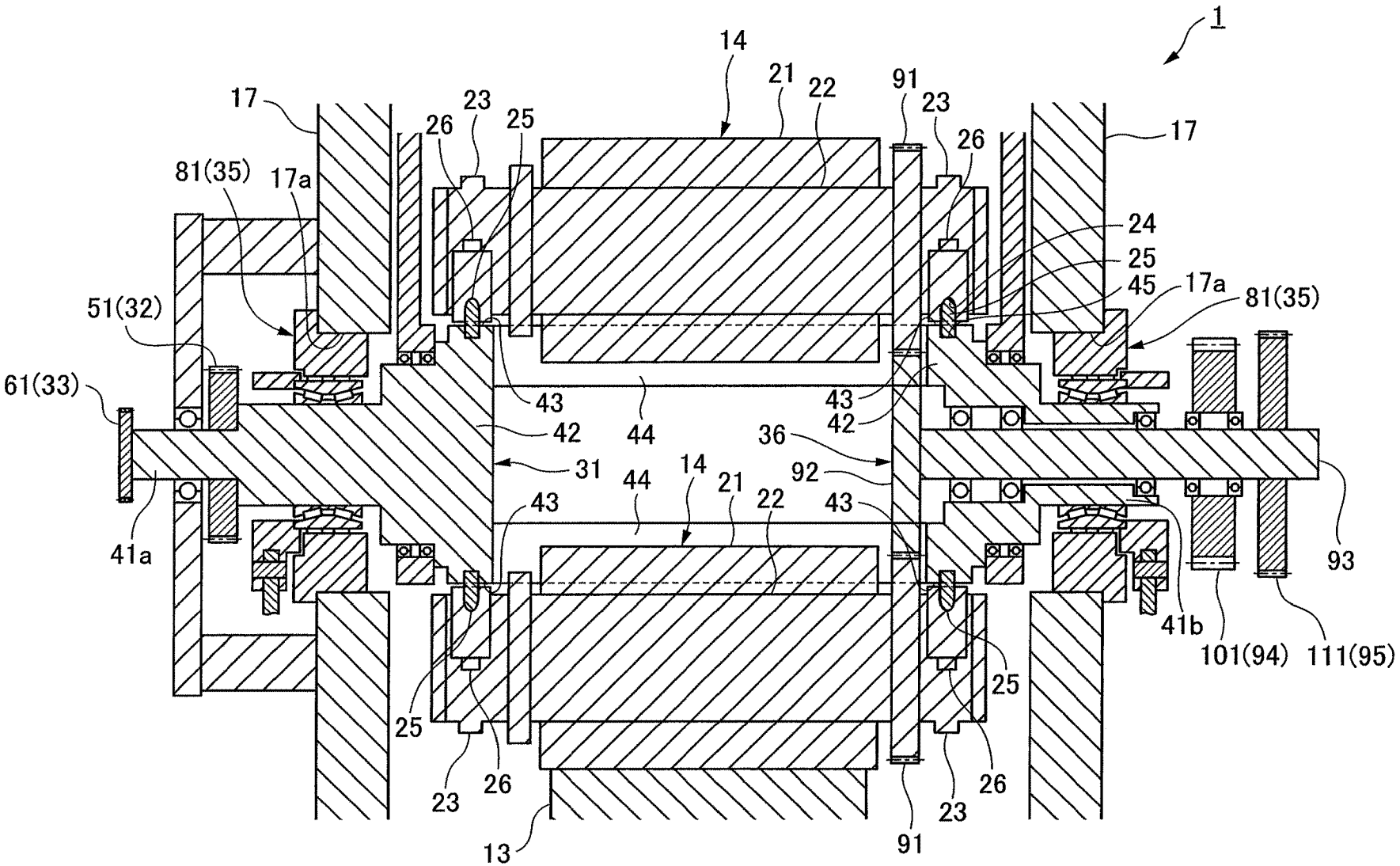
FIG. 2 is an explanatory view illustrating the configuration of the liquid transfer apparatus according to Embodiment 1 (cross-sectional view along the line II-II in FIG. 1 and viewed in the direction of the arrows).

As illustrated in FIGS. 1 and 2, each of the anilox rollers 14 is substantially formed of a cylinder portion 21 having a surface on which an engraving with a predetermined cell shape and a cell volume is formed, a rotary shaft portion 22 being a rotation center of the cylinder portion 21, and attachment portions 23 provided on both sides of the rotary shaft portion 22 in an axial direction thereof (left-right direction in FIG. 2).

The anilox roller 14 which transfers the coating liquid to the sheet on the impression cylinder 12 (which is in contact with the coater cylinder 13) is one of the multiple anilox rollers 14 held by the anilox roller switching device 16 and is the anilox roller 14 moved from the separated position to the contact position at the transfer operation position (lower position in FIG. 1).

As illustrated in FIGS. 1 and 2, the anilox roller switching device 16 is provided with a roller magazine (roller holding device) 31 which detachably holds the multiple anilox rollers 14.

The roller magazine 31 is substantially formed of rotary shaft portions 41*a*, 41*b* which penetrate a frame 17 of the coating apparatus 1 to be rotatably supported by the frame 17, two side plate portions 42 which extend from axial direction inner portions of the rotary shaft portions 41*a*, 41*b* in a radial direction (up-down direction in FIG. 2), multiple attachment grooves 43 which are formed in the side plate portions 42 to be open to the outer side in the radial direction, and connection portions 44 which are provided between the attachment grooves 43 adjacent in a circumferential direction to connect the two side plate portions 42.

The attachment grooves 43 are formed to be capable of engaging with the attachment portions 23 of the anilox rollers 14, and pin holes 24, 45 for alignment are formed in the attachment portions 23 and the attachment grooves 43, respectively. Accordingly, the anilox rollers 14 are aligned relative to the roller magazine 31 by alignment pins 25 and are fixed to the roller magazine 31 by fixation bolts 26 in a state where the attachment portions 23 on both sides of the anilox rollers 14 in the axial direction thereof are engaged with the attachment grooves 43 of the roller magazine 31.

Moreover, the multiple attachment grooves 43 are provided at even angular intervals about the axis of rotation of the roller magazine 31 (four attachment grooves are provided at 90° intervals in the embodiment). Specifically, the multiple anilox rollers 14 are arranged at different phases about the axis of rotation of the roller magazine 31 and are supported to be rotatable about axes of rotation parallel to the axis of rotation of the roller magazine 31.

Figure 3:
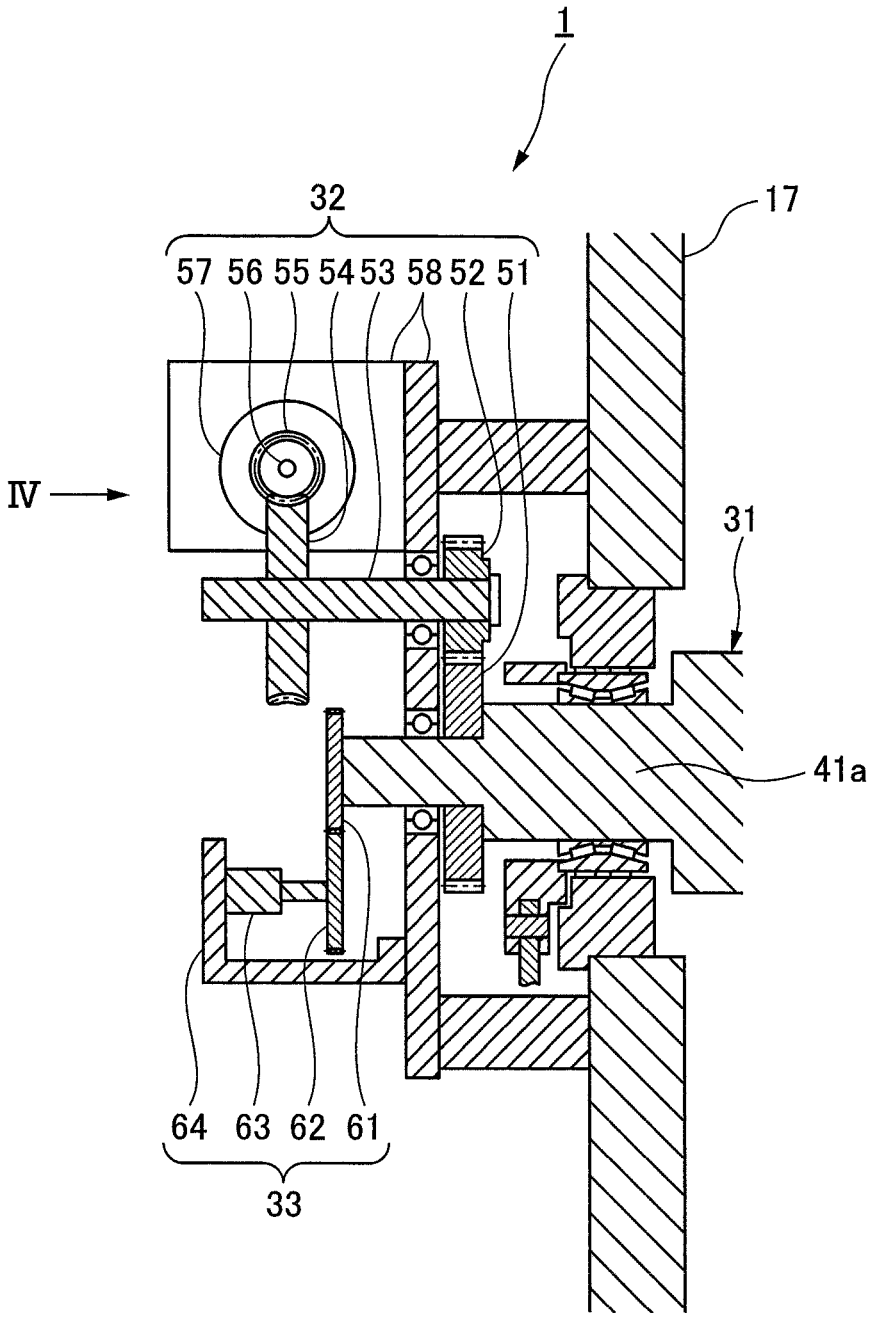
FIG. 3 is an explanatory view illustrating a configuration of a magazine rotation device in the liquid transfer apparatus according to Embodiment 1.
Figure 4:
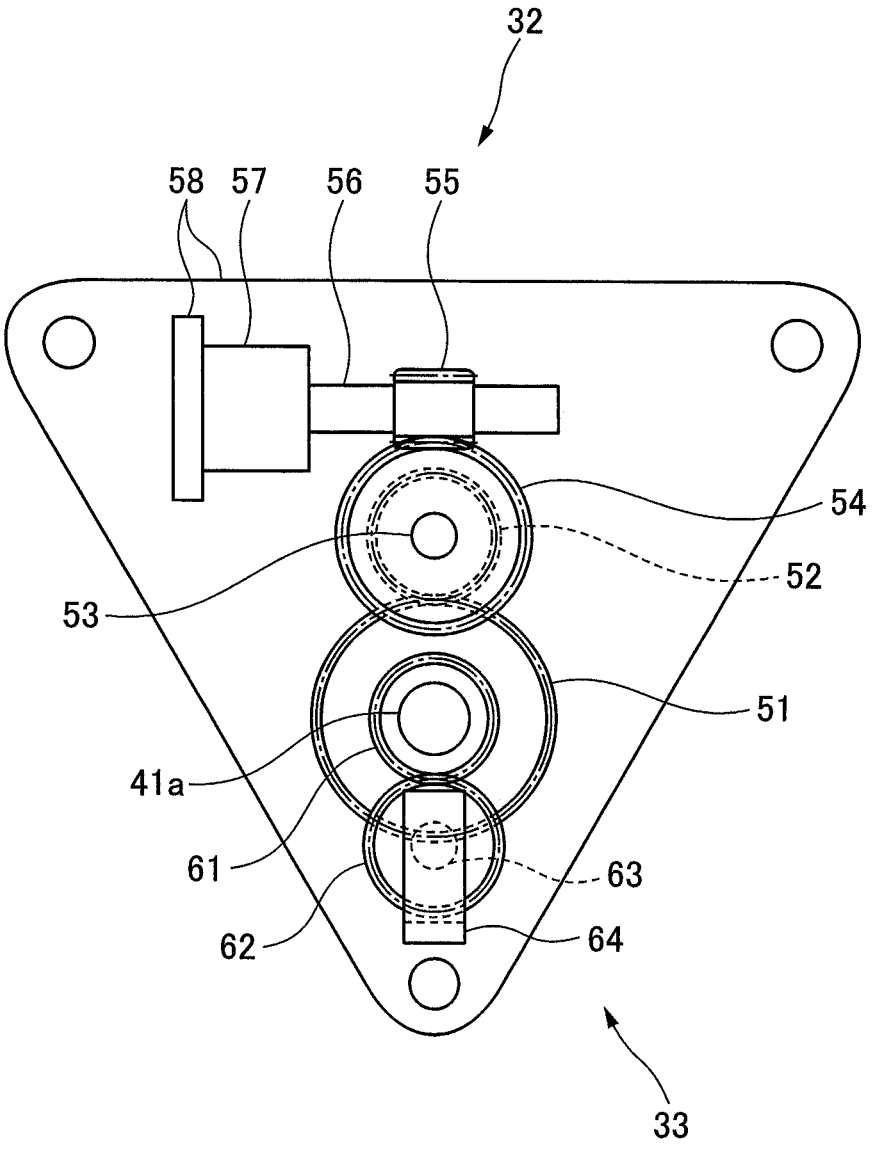
FIG. 4 is an explanatory view illustrating the configuration of the magazine rotation device in the liquid transfer apparatus according to Embodiment 1 (view in the direction of the arrow IV in FIG. 3).

Moreover, as illustrated in FIGS. 2 to 4, the anilox roller switching device 16 is provided with a magazine rotation device 32 by which the roller magazine 31 is rotationally driven about the axis of rotation.

The magazine rotation device 32 is substantially formed of a magazine rotation gear (spur gear) 51 which is attached to the rotary shaft portion 41*a* on one axial side of the roller magazine 31, a first connection gear (spur gear) 52 which meshes with the magazine rotation gear 51, a second connection gear (worm gear) 54 which is rotated coaxially with the first connection gear 52 via a connection shaft 53, a motor rotation gear (worm gear) 55 which meshes with the second connection gear 54, and a magazine rotation motor 57 which is connected to the motor rotation gear 55 via a motor rotary shaft 56. Note that the connection shaft 53 is rotatably supported on a sub-frame 58 fixed to the frame 17, and the magazine rotation motor 57 is fixed to the sub-frame 58.

In the aforementioned configuration, when the magazine rotation motor 57 is rotationally driven in the magazine rotation device 32, the roller magazine 31 is rotationally driven together with the magazine rotation gear 51 via the motor rotation gear 55, the second connection gear 54, and the first connection gear 52. Rotationally driving the roller magazine 31 with the magazine rotation device 32 can cause the anilox rollers 14 to rotationally move about the axis of rotation of the roller magazine 31.

As illustrated in FIG. 1, each of the anilox rollers 14 is moved by the rotational drive of the roller magazine 31 to, for example, the transfer operation position (a lower position in the vertical direction, a lower position in FIG. 1) for transferring the liquid to the sheet on the impression cylinder 12 via the coater cylinder 13, a replacement position (an upper position in the vertical direction, an upper position in FIG. 1) for replacing the anilox roller 14 held by the roller magazine 31 with another anilox roller, or a roller cleaning position (position on one side between the transfer operation position and the replacement position, a left position in FIG. 1) for cleaning the anilox roller 14.

Moreover, as illustrated in FIGS. 2 to 4, the anilox roller switching device 16 is provided with a magazine rotation detection device 33 which detects a rotating operation (rotation phase) of the roller magazine 31.

The magazine rotation detection device 33 is substantially formed of a first connection gear (spur gear) 61 which is provided on the rotary shaft portion 41*a* on the one axial side of the roller magazine 31, a second connection gear (spur gear) 62 which meshes with the first connection gear 61, and an encoder 63 which is connected to the second connection gear 62. Note that the encoder 63 is fixed to a sub-frame 64 fixed to the frame 17.

In the configuration described above, the first connection gear 61 is rotationally driven together with the roller magazine 31 by the magazine rotation device 32. The second connection gear 62 meshing with the first connection gear 61 is then rotationally driven, and the rotating operation (rotation phase) of the second connection gear 62 is detected by the encoder 63.

Figure 5:
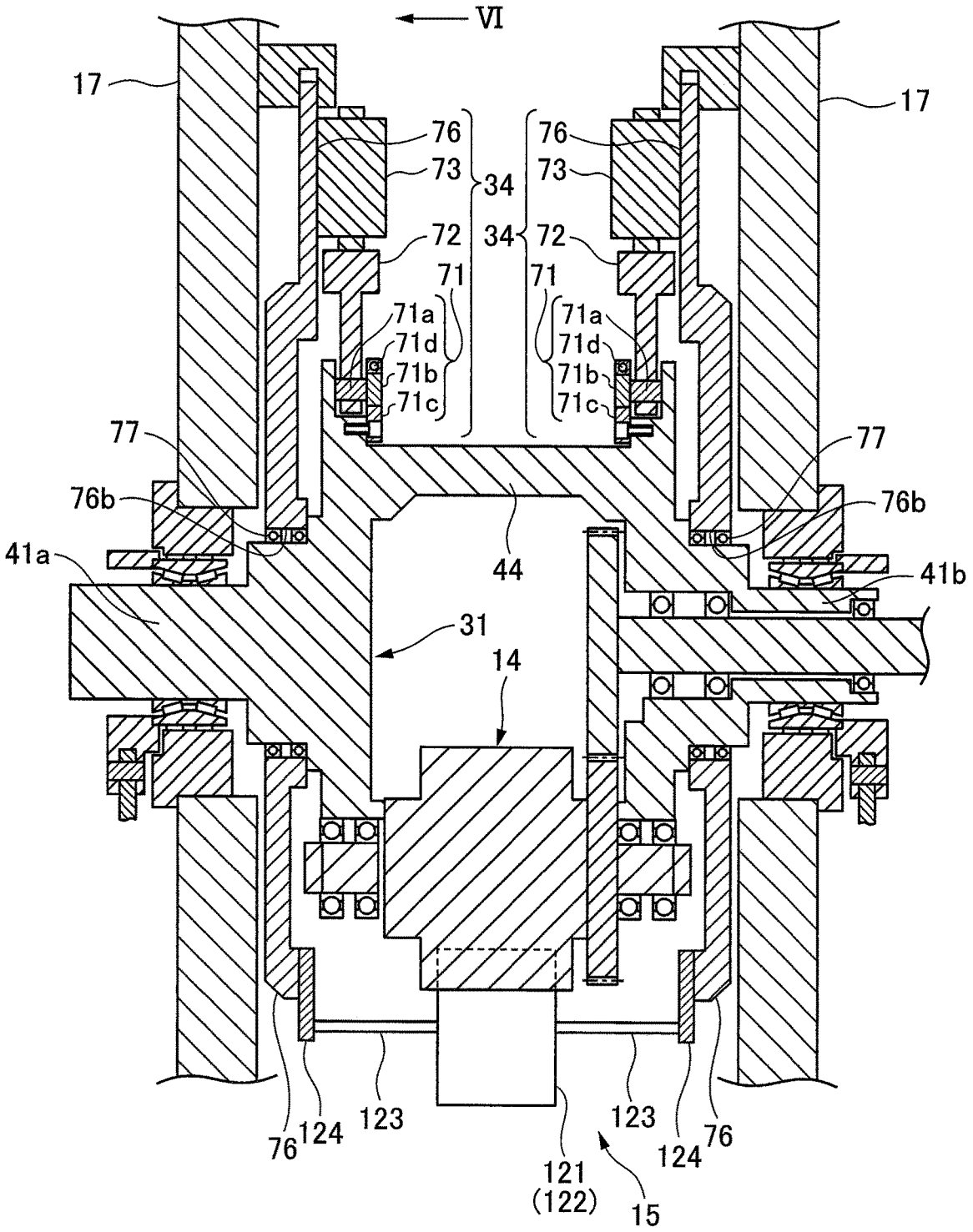
FIG. 5 is an explanatory view illustrating a configuration of a magazine alignment device in the liquid transfer apparatus according to Embodiment 1.
Figure 6:
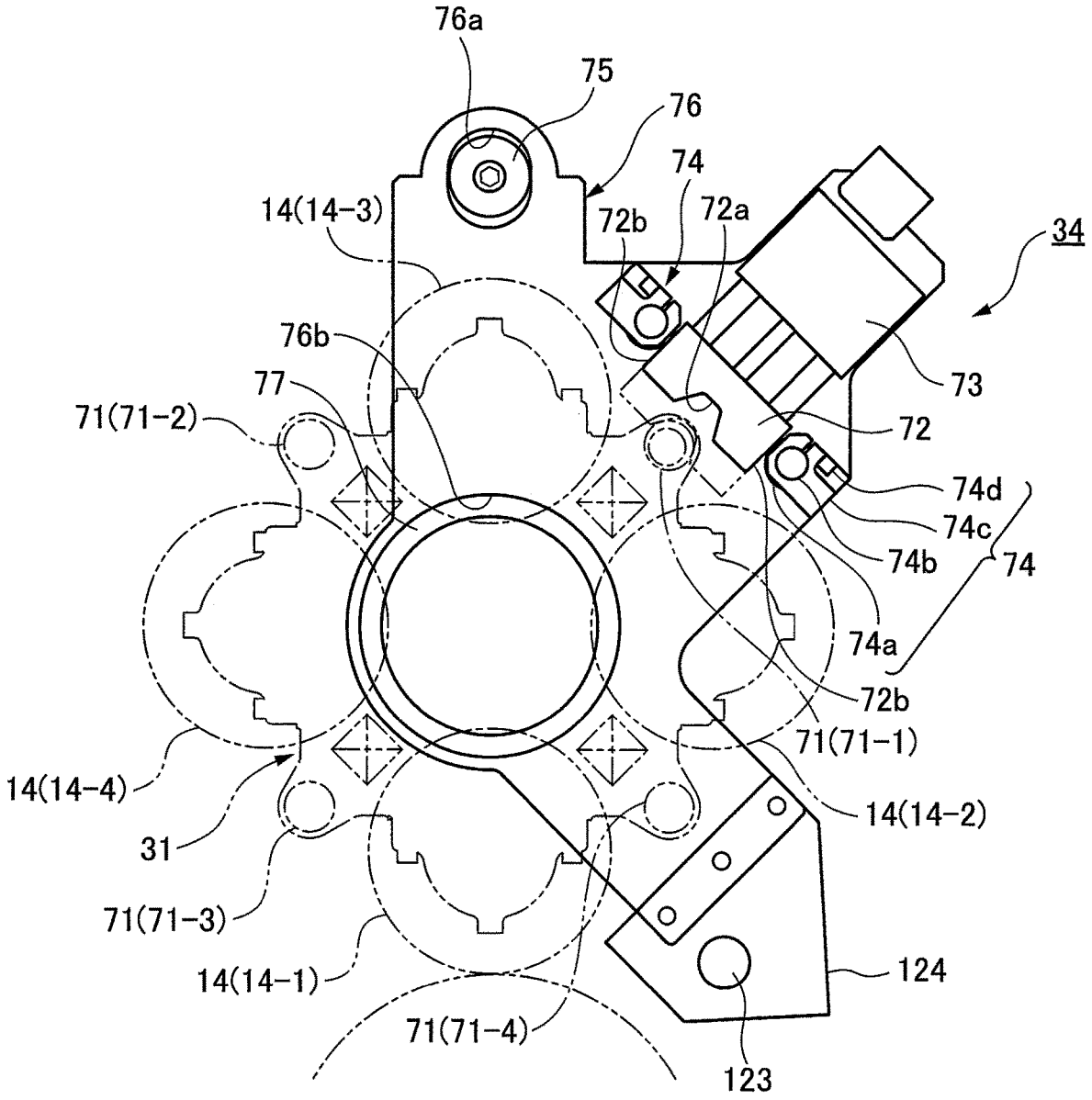
FIG. 6 is an explanatory view illustrating the configuration of the magazine alignment device in the liquid transfer apparatus according to Embodiment 1 (view in the direction of the arrow VI in FIG. 5).

Moreover, as illustrated in FIGS. 1, 5, and 6, the anilox roller switching device 16 is provided with a magazine alignment device 34 which aligns one (predetermined one) of the anilox rollers 14 held by the roller magazine 31 at the transfer operation position.

The magazine alignment device 34 is substantially formed of alignment rollers 71 which are fixed to the roller magazine 31, a roller engagement member 72 which can engage with the alignment rollers 71, and an alignment cylinder 73 which can move the roller engagement member 72 toward and away from the alignment rollers 71.

Multiple (four in the embodiment which is the same as the number of the anilox rollers 14) alignment rollers 71 are provided in the circumferential direction of the roller magazine 31, and the magazine alignment device 34 can individually adjust the positions (transfer operation positions) of the multiple anilox rollers 14 held by the roller magazine 31.

Specifically, the alignment roller 71-1 located on an upper right side corresponds to the anilox roller 14-1 located on the lower side, the alignment roller 71-2 located on an upper left side corresponds to the anilox roller 14-2 located on the right side, the alignment roller 71-3 located on a lower left side corresponds to the anilox roller 14-3 located on the upper side, and the alignment roller 71-4 located on a lower right side corresponds to the anilox roller 14-4 located on the left side.

When the alignment cylinder 73 is extended, the roller engagement member 72 provided at a front end portion of the alignment cylinder 73 is engaged with one of the alignment rollers 71 (71-1). The engagement between the alignment roller 71 (71-1) and the roller engagement member 72 restricts the movement of the alignment roller (71-1) about the axis of rotation of the roller magazine 31, and the rotating operation of the roller magazine 31 is restricted at a predetermined rotation phase. In other words, in the roller magazine 31, the anilox roller 14 (14-1) corresponding to the alignment roller 71 (71-1) is aligned (fixed) at the transfer operation position.

When the anilox roller 14 (14-1) held by the roller magazine 31 is aligned at the transfer operation position, the anilox roller 14 (14-3) held on the opposite side (upper side in FIG. 1) of the roller magazine 31 is aligned at the replacement position and the anilox roller 14 (14-4) held between these anilox rollers 14 (on the left side in FIG. 1) is aligned at the cleaning position.

Meanwhile, when the alignment cylinder 73 is contracted, the roller engagement member 72 provided in the front end portion of the alignment cylinder 73 is disengaged from the alignment roller 71. Disengaging of the roller engagement member 72 from the alignment roller 71 cancels the restriction on the rotating operation of the roller magazine 31, and the anilox rollers 14 held by the roller magazine 31 can be rotated.

The multiple alignment rollers 71 (71-1, 71-2. 71-3, 71-4) in the magazine alignment device 34 all have the same configuration and are each substantially formed of roller members 71*a* which engage with the roller engagement member 72 (comes into contact with engagement portions 72*a* being wedge-shaped grooves formed in the roller engagement member 72), disc-shaped roller holding members 71*b* by which the roller members 71*a* are rotatably held, and main body portions 71*c* by which the roller holding members 71*b* are rotatably held. The axes of rotation of the roller members 71*a* and the axes of rotation of the roller holding members 71*b* are shifted from each other. In other words, the roller members 71*a* and the roller holding members 71*b* are provided on the main body portions 71*c* to be eccentric to each other.

The roller holding members 71*b* are fixed to the main body portions 71*c* by split clamping using screw members 71*d*, and the roller members 71*a* can be moved relative to the main body portion 71*c* in directions orthogonal to the axes of rotation by loosening the screw members 71*d* and rotating the roller holding members 71*b*. In other words, the eccentric mechanism in each of the alignment rollers 71 enables adjustment of the rotation phase of the roller magazine 31, that is adjustment of the position (transfer operation position) of the anilox roller 14 held by the roller magazine 31 whose rotating operation is restricted by the engagement (contact) between the alignment roller 71 (roller members 71*a*) and the roller engagement member 72.

In summary, the magazine alignment device 34 can individually adjust the multiple alignment rollers 71 (71-1, 71-2, 71-3, 71-4) and, by adjusting these alignment rollers 71 (71-1, 71-2, 71-3, 71-4), individually adjust the transfer operation positions of the anilox rollers 14 (14-1, 14-2, 14-3, 14-4) corresponding to the respective alignment rollers 71.

Moreover, the magazine alignment device 34 is provided with a guide roller 74 which guides the roller engagement member 72 when the alignment cylinder 73 performs extending and contracting operations (extends or contracts). The guide roller 74 is substantially formed of roller members 74*a* which come into contact with side surfaces (guide surfaces) 72*b* of the roller engagement member 72, roller holding members 74*b* by which the roller members 74*a* are rotatably held, and main body portions 74*c* by which the roller holding members 74*b* are rotatably held. The axes of rotation of the roller members 74*a* and the axes of rotation of the roller holding members 74*b* are shifted from one another, that is, the roller members 74*a* and the roller holding members 74*b* are provided on the main body portions 74*c* to be eccentric to one another.

The roller holding members 74*b* are fixed to the main body portions 74*c* by split clamping using screw members 74*d*, and the roller members 74*a* can be moved relative to the main body portions 74*c* in directions orthogonal to the axes of rotation by loosening the screw members 74*d* and rotating the roller holding members 74*b*. In other words, the eccentric mechanism in the guide roller 74 enables adjustment of the position of the roller engagement member 72 (engagement portions 72*a*) in correspondence with the positions of the alignment rollers 71 (roller members 71*a*), the engagement member 72 guided by contact between the guide roller 74 (roller members 74*a*) and the roller engagement member 72 (side surfaces 72*b*). Since adjusting the position of the roller engagement member 72 changes the engagement positions with all of the alignment rollers 71 (71-1, 71-2, 71-3, 71-4), the transfer operation positions of the anilox rollers 14 (14-1, 14-2, 14-3, 14-4) can be adjusted all at once.

In this configuration, the alignment cylinder 73 and the guide roller 74 are fixed to sub-frames 76 pin-connected to the frame 17 via pin members 75. The pin members 75 are fixed to the frame 17 and are inserted into pin holes 76*a* formed in the sub-frames 76. The pinholes 76*a* are holes elongated in the vertical direction (up-down direction in FIG. 6) and the sub-frames 76 are supported to be movable relative to the frame 17 only in the direction in which the pin holes 76*a* are elongated (vertical direction). Note that the rotary shaft portions 41*a*, 41*b* of the roller magazine 31 are supported on insertion holes 76*b* formed in the sub-frames 76 via bearings 77 and the rotating operation of the roller magazine 31 is not transmitted to the sub-frames 76.

Figure 7:
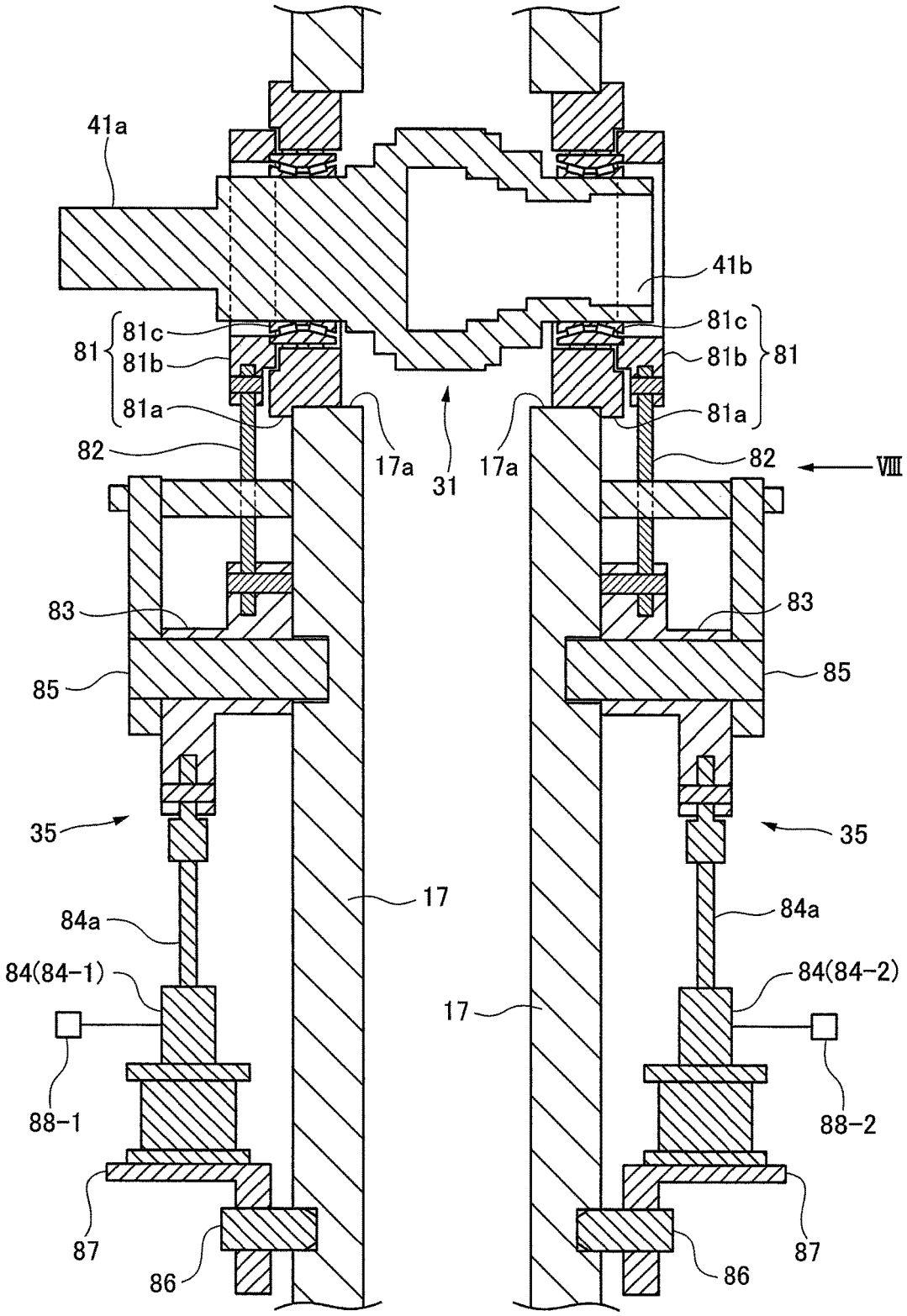
FIG. 7 is an explanatory view illustrating a configuration of a roller contact-separation device in the liquid transfer apparatus according to Embodiment 1.
Figure 8:
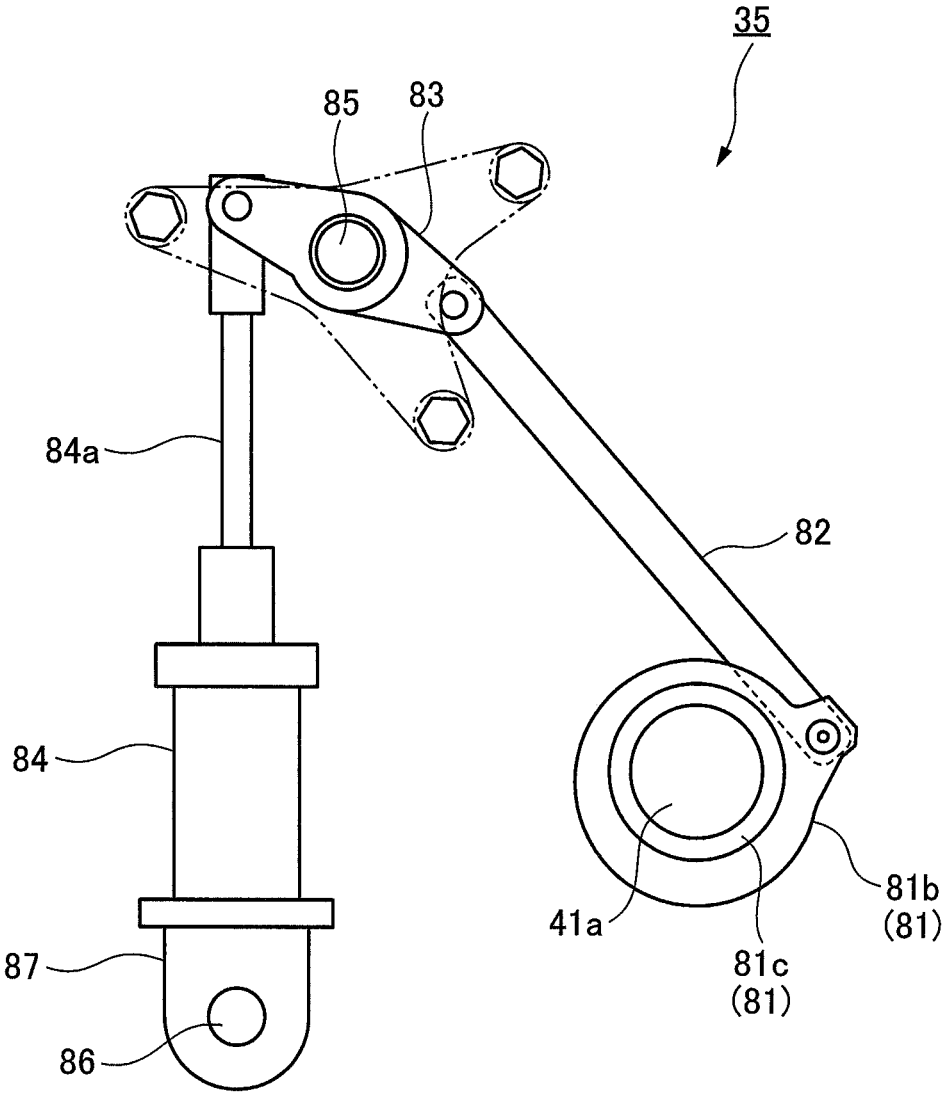
FIG. 8 is an explanatory view illustrating the configuration of the roller contact-separation device in the liquid transfer apparatus according to Embodiment 1 (view in the direction of the arrow VIII in FIG. 7).

Moreover, as illustrated in FIGS. 2, 7, and 8, the anilox roller switching device 16 is provided with a roller contact-separation device 35 which moves the anilox roller 14, aligned at the predetermined position facing the coater cylinder 13, toward and away from the coater cylinder 13 (brings the anilox roller 14 into and out of contact with the coater cylinder 13).

The roller contact-separation device 35 is substantially formed of eccentric bearings 81 by which the rotary shaft portions 41*a*, 41*b* of the roller magazine 31 are rotatably supported, first connection members 82 whose one end portions are connected to the eccentric bearings 81, second connection members 83 whose one end portions are connected the other end portions of the first connection members 82, and contact-separation motors 84 which are connected to the other end portions of the second connection members 83 via contact-separation rods 84*a*.

In this configuration, each of the eccentric bearings 81 is substantially formed of a fixation portion 81*a* fixed to a bearing hole 17*a* formed in the frame 17, an eccentric portion 81*b* rotatably supported on the fixation portion 81*a*, and a rotation portion 81*c* rotatably and eccentrically supported on the eccentric portion 81*b*, and each of the first connection members 82 is connected to the eccentric portion 81*b* of the corresponding eccentric bearings 81. Moreover, the second connection members 83 are pin-connected to the frame 17 via pin members 85 and are rotated (swung) about the pin members 85. Note that the contact-separation motors 84 are fixed to sub-frames 87 pin-connected to the frame 17 via pin members 86 and are supported to be rotatable relative to the frame 17. Furthermore, the contact-separation rods 84*a* are moved (extended and contacted) in the axial direction by being driven by the contact-separation motors 84.

Accordingly, in the roller contact-separation device 35, when the contact-separation rods 84*a* are moved in the axial direction (extending operation or contracting operation) by being driven by the contact-separation motors 84, the second connection members 83 are rotated (swung) about the pin members 85 and the first connection members 82 are moved in a substantially axial direction (reciprocating movement) to rotate the eccentric portions 81*b* of the eccentric bearings 81 relative to the fixation portions 81*a*. In other words, the eccentric mechanisms in the eccentric bearings 81 cause the roller magazine 31 to move in the direction orthogonal to the axial direction and the anilox roller 14 held by the roller magazine 31 is moved toward and away from the coater cylinder 13.

In the embodiment, it is assumed that, when the contact-separation rods 84*a* are moved (extended) toward one axial side by the contact-separation motors 84 to be set at first predetermined positions (extended to a first predetermined length, that is a roller contact position length), the anilox roller 14 at the transfer operation position is disposed at the contact position with the coater cylinder 13 by the eccentric mechanisms in the eccentric bearings 81. Moreover, it is assumed that, when the contact-separation rods 84*a* are moved (contracted) toward the other axial side by the contact-separation motors 84 to be set at second predetermined positions different from the first predetermined positions (contracted to a second predetermined length shorter than the first predetermined length, that is a roller separated position length), the anilox roller 14 at the transfer operation position is disposed at the separated position from the coater cylinder 13 by the eccentric mechanisms in the eccentric bearings 81. Furthermore, it is assumed that the contact position, that is printing pressure between the coater cylinder 13 and the anilox roller 14 is adjusted by the eccentric mechanisms in the eccentric bearings 81 by causing the contact-separation motors 84 to move the contact-separation rods 84*a* in the axial direction around the first predetermined positions (perform the extending and contracting operations around the first predetermined length).

Moreover, in the embodiment, the contact-separation motors 84 connected respectively to the rotary shaft portions 41*a*, 41*b* of the roller magazine 31 can be driven independently. Specifically, in FIG. 7, one contact-separation motor 84-1 connected to the rotary shaft portion 41*a* on the one axial side of the roller magazine 31 and the other contact-separation motor 84-2 connected to the rotary shaft portion 41*b* on the other axial side of the roller magazine 31 are driven at the same phase or different phases.

In other words, the roller contact-separation device 35 can move the anilox roller 14 while keeping it parallel to the coater cylinder 13 by driving the contact-separation motors 84 (84-1, 84-2) at the same phase and tilt the anilox roller 14 relative to the coater cylinder 13 by driving the contact-separation motors 84 (84-1, 84-2) at different phases.

The printing pressure between the coater cylinder 13 and the anilox roller 14 can be varied in the axial direction by bringing the anilox roller 14 in contact with the coater cylinder 13 with the anilox roller 14 tilted relative to the coater cylinder 13 as described above. Accordingly, the sheet can be subjected to such coating that the thickness of liquid (for example, coating liquid such as varnish) varies in the axial direction.

Moreover, the roller contact-separation device 35 is provided with encoders 88-1, 88-2 connected to the contact-separation motors 84 (one contact-separation motor 84-1 and the other contact-separation motor 84-2). The encoders 88-1, 88-2 detect the rotation phases (that is, movement amounts of the contact-separation rods 84*a*. the magnitude of the printing pressure between the coater cylinder 13 and the anilox roller 14) of the contact-separation motors 84 (one contact-separation motor 84-1 and the other contact-separation motor 84-2).

Note that, as illustrated in FIGS. 5 and 6, since the sub-frames 76 connected to the roller magazine 31 via the bearings 77 are supported to be movable relative to the frame 17 in the vertical direction, the sub-frames 76 are moved together with the roller magazine 31 in the same direction (direction orthogonal to the axial direction, vertical direction) by the operation of the roller contact-separation device 35. Accordingly, the alignment cylinders 73 and the guide roller 74 fixed to the sub-frames 76 are moved together with the roller magazine 31 and the anilox roller 14 in the direction orthogonal to the axial direction by the operation of the roller contact-separation device 35.

Figure 9:
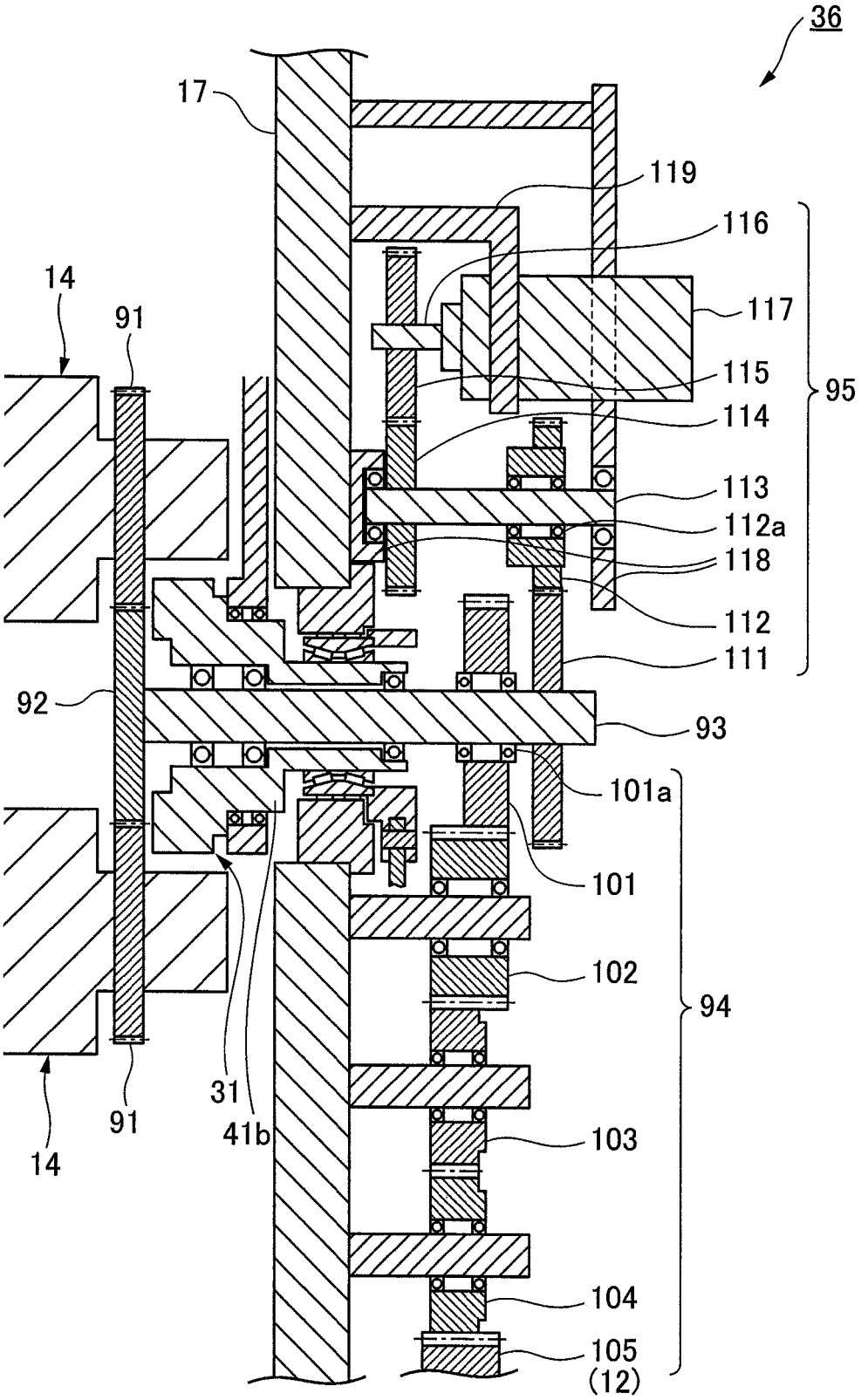
FIG. 9 is an explanatory view illustrating a configuration of a roller rotation device in the liquid transfer apparatus according to Embodiment 1.

Moreover, as illustrated in FIGS. 2 and 9, the anilox roller switching device 16 is provided with a roller rotation device 36 by which the anilox rollers 14 held by the roller magazine 31 is rotationally driven.

The roller rotation device 36 is provided with multiple roller gears 91 which are provided on the other axial side (right side in FIGS. 2 and 9) of the multiple anilox rollers 14 held by the roller magazine 31 and a roller rotation gear 92 which meshes with the multiple roller gears 91. The roller rotation gear 92 is provided with a roller rotation gear shaft 93 protruding from the rotation center of the roller rotation gear 92 toward the other axial side. The roller rotation gear shaft 93 is rotatably and coaxially supported in the rotary shaft portion 41*b* on the other axial side of the roller magazine 31.

A roller linked rotation mechanism 94 by which the roller rotation gear shaft 93 is rotationally driven in link with the impression cylinder 12 and a roller independent rotation mechanism 95 by which the roller rotation gear shaft 93 is rotationally driven independent of the impression cylinder 12 are provided at an end of the roller rotation gear shaft 93 on the other axial side. The roller rotation gear shaft 93 is rotationally driven by the roller linked rotation mechanism 94 or the roller independent rotation mechanism 95.

The roller linked rotation mechanism 94 is substantially formed of a roller linked rotation gear 101 which is attached to the end of the roller rotation gear shaft 93 on the other axial side, a first connection gear 102 which meshes with the roller linked rotation gear 101, a second connection gear 103 which meshes with the first connection gear 102, a third connection gear 104 which meshes with the second connection gear 103, and an impression cylinder drive gear 105 which meshes with the third connection gear 104 and which drives the impression cylinder 12.

In this configuration, the first connection gear 102, the second connection gear 103, and the third connection gear 104 are rotatably supported on the frame 17, and the impression cylinder drive gear 105 is fixed to the impression cylinder 12 to be rotationally driven together with the impression cylinder 12. Moreover, the roller linked rotation gear 101 is provided with a clutch mechanism 101*a* formed of a one-way clutch mechanism and the rotating operation of the impression cylinder 12 is transmitted to the roller rotation gear shaft 93.

In the roller linked rotation mechanism 94, when the impression cylinder 12, that is the impression cylinder drive gear 105 is rotationally driven, the roller linked rotation gear 101 is rotationally driven via the third connection gear 104, the second connection gear 103, and the first connection gear 102. When the roller rotation gear shaft 93 is rotationally driven together with the roller linked rotation gear 101, the multiple anilox rollers 14 are rotationally driven via the roller rotation gear 92 and the roller gears 91.

The roller independent rotation mechanism 95 is substantially formed of a roller independent rotation gear (spur gear) 111 which is attached to the end of the roller rotation gear shaft 93 on the other axial side, a first connection gear (spur gear) 112 which meshes with the roller independent rotation gear 111, a second connection gear (spur gear) 114 which is rotated coaxially with the first connection gear 112 via a connection shaft 113, a motor rotation gear (spur gear) 115 which meshes with the second connection gear 114, and a roller independent rotation motor 117 which is connected to the motor rotation gear 115 via a motor rotary shaft 116.

The connection shaft 113 is rotationally supported on a sub-frame 118 fixed to the frame 17 and the roller independent rotation motor 117 is fixed to a sub-frame 119 fixed to the frame 17. The first connection gear 112 is provided with a clutch mechanism 112*a* formed of a one-way clutch mechanism, and a rotating operation of the roller independent rotation motor 117 is transmitted to the roller rotation gear shaft 93 via the roller independent rotation gear 111.

In the roller independent rotation mechanism 95, when the roller independent rotation motor 117 is driven to rotate, the roller independent rotation gear 111 is rotationally driven via the motor rotation gear 115, the second connection gear 114, and the first connection gear 112. When the roller rotation gear shaft 93 is rotationally driven together with the roller independent rotation gear 111, the multiple anilox rollers 14 are rotationally driven via the roller rotation gear 92 and the roller gears 91.

As illustrated in FIGS. 1, 5, and 6, the chamber device 15 in the coating apparatus 1 is substantially formed of a chamber 121 which contains the coating liquid and which can supply the coating liquid to the anilox roller 14, a holding lever 122 which holds the chamber 121, a pin member 123 which protrudes from both sides of the holding lever 122 in the axial direction (left-right direction in FIG. 5), and attachment plates 124 which are fixed to the sub-frames 76 and by which the pin member 123 is rotatably supported.

An operation of rotating the holding lever 122 together with the pin member 123 relative to the attachment plates 124 (sub-frames 76) causes the chamber 121 to move toward and away from the anilox roller 14 at the transfer operation position. The chamber 121 is moved toward and away from the anilox roller 14 to be moved between a liquid supply operation position (see the solid lines in FIG. 1) where the chamber 121 is disposed close to the anilox roller 14 to supply the coating liquid to the anilox roller 14 and a retreat position (see two-dot chain lines in FIG. 1) where the chamber 121 is disposed away from the anilox roller 14 to allow the rotation drive of the roller magazine 31 (rotation movement of the anilox roller 14). In this case, the rotating operation of the chamber 121 and the holding lever 122 is performed by using a drive source such as a motor or a cylinder or manually by a worker.

Moreover, the chamber device 15 is provided with a chamber detection device 125 which can detect that the chamber device 15 is disposed at the retreat position. When the chamber detection device 125 detects the presence of the chamber device 15, the chamber device 15 is determined to be disposed at the retreat positon. Meanwhile, when the chamber detection device 125 does not detect the presence of the chamber device 15, the chamber device 15 is determined not to be disposed at the retreat positon but to be disposed at the liquid supply operation position. As a matter of course, a second chamber detection device (not illustrated) which can detect that the chamber device 15 is disposed at the liquid supply operation position may be provided.

As illustrated in FIG. 1, the housing 11 in the coating apparatus 1 is provided with an opening portion 131 open on the upper side (upper side in the vertical direction, upper side in FIG. 1) of the anilox roller switching device 16, and the opening portion 131 is provided with an opening-closing door 132 which is opened toward the outside (upper side in the vertical direction, upper side in FIG. 1) of the housing 11.

The opening portion 131 is an opening for replacing the anilox roller 14 held by the roller magazine 31. By opening the opening-closing door 132, the worker can unload anilox roller 14 at the replacement position through the opening portion 131 to the outside of the housing 11 by using a crane and also load another anilox roller into the housing 11 through the opening portion 131 by using the crane to install it in the anilox roller switching device 16 (roller magazine 31).

Note that the worker performs the replacement work of the anilox roller 14 in the anilox roller switching device 16 by using the not-illustrated crane, and a space for this work (space above the housing 11 (coating apparatus 1) in the vertical direction) is not a small space between units in the printing press. Thus, the worker can perform the work easily.

Moreover, the housing 11 in the coating apparatus 1 is provided with an opening portion 133 open on a side (side in the horizontal direction, right side in FIG. 1) of the anilox roller switching device 16, and the opening portion 133 is provided with an opening-closing door 134 which is opened toward the outside (side in the horizontal direction, right side in FIG. 1) of the housing 11.

The opening portion 133 is an opening for maintenance, inspection, and the like of the anilox roller switching device 16 and the chamber device 15. By opening the opening-closing door 134, the worker can access the anilox roller switching device 16 and the chamber device 15 in the housing 11 through the opening portion 133 and perform maintenance, inspection, and the like of these devices.

Moreover, the housing 11 in the coating apparatus 1 is provided with an opening portion 135 open on a side (side in the horizontal direction, left side in FIG. 1) of the anilox roller switching device 16, and the opening portion 135 is provided with an opening-closing door 136 which is opened toward the outside (side in the horizontal direction, left side in FIG. 1) of the housing 11.

The opening portion 135 is an opening for cleaning the anilox roller 14 held in the roller magazine 31. By opening the opening-closing door 136, the worker can access the anilox roller 14 at the cleaning position through the opening portion 135 and perform cleaning and the like of the anilox roller 14.

Figure 11:
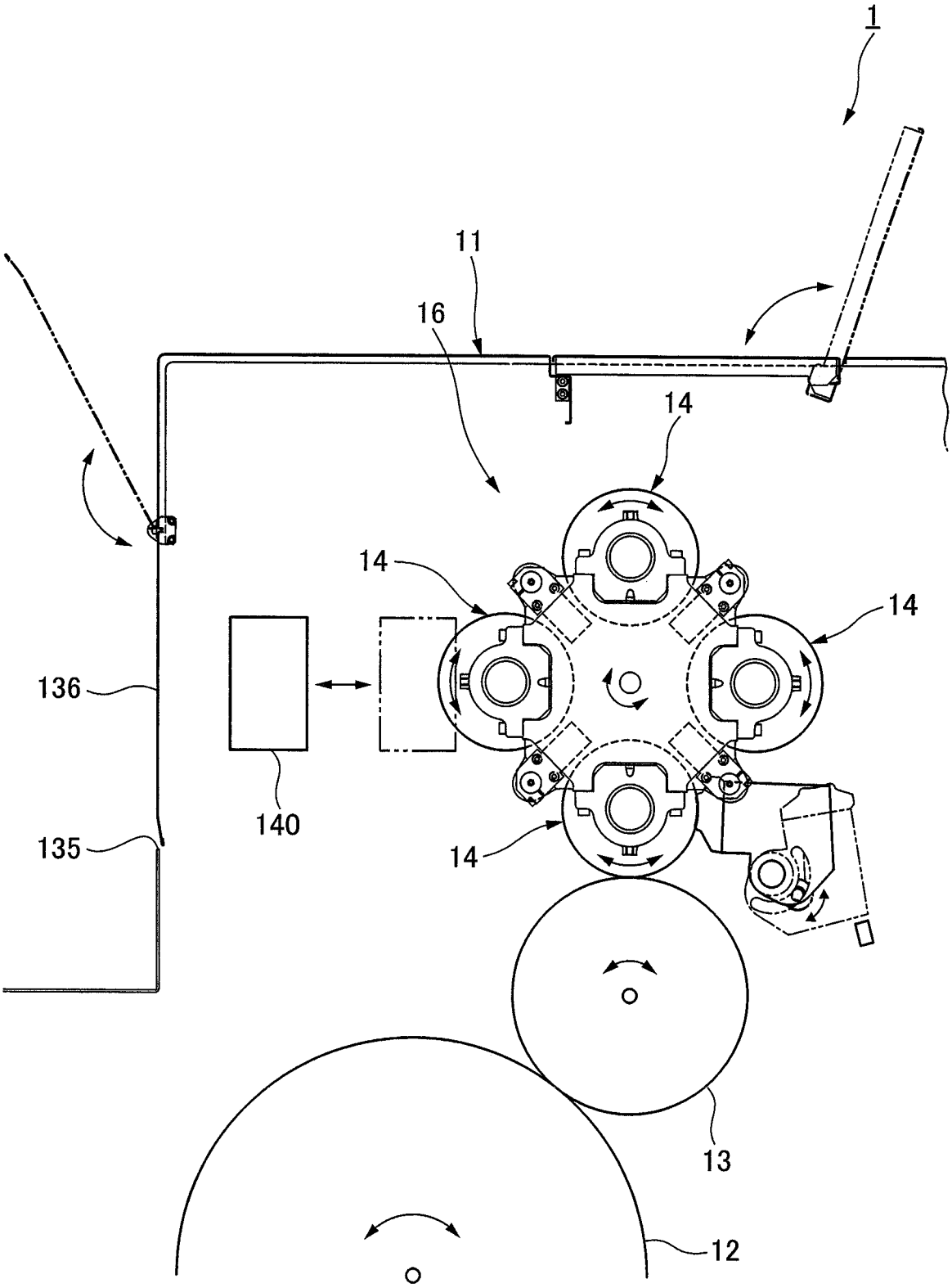
FIG. 11 is an explanatory view illustrating an example in which an automatic cleaning device is additionally provided in the liquid transfer apparatus according to Embodiment 1 (corresponding to FIG. 1).

As a matter of course, the present invention is not limited to the configuration in which the worker accesses the anilox roller 14 at the cleaning position through the opening portion 135 and cleans the anilox roller 14 as in the embodiment. For example, as illustrated in FIG. 11, an automatic cleaning device 141 which can clean the anilox roller 14 at the cleaning position (left side in FIG. 11) by moving toward and away from the anilox roller 14 can be provided. When the automatic cleaning device 141 is arranged in the housing 11 as described above, providing the opening portion 135 and the opening-closing door 136 allows easy maintenance, inspection, and the like of the automatic cleaning device 141 in the housing 11.

Figure 10:
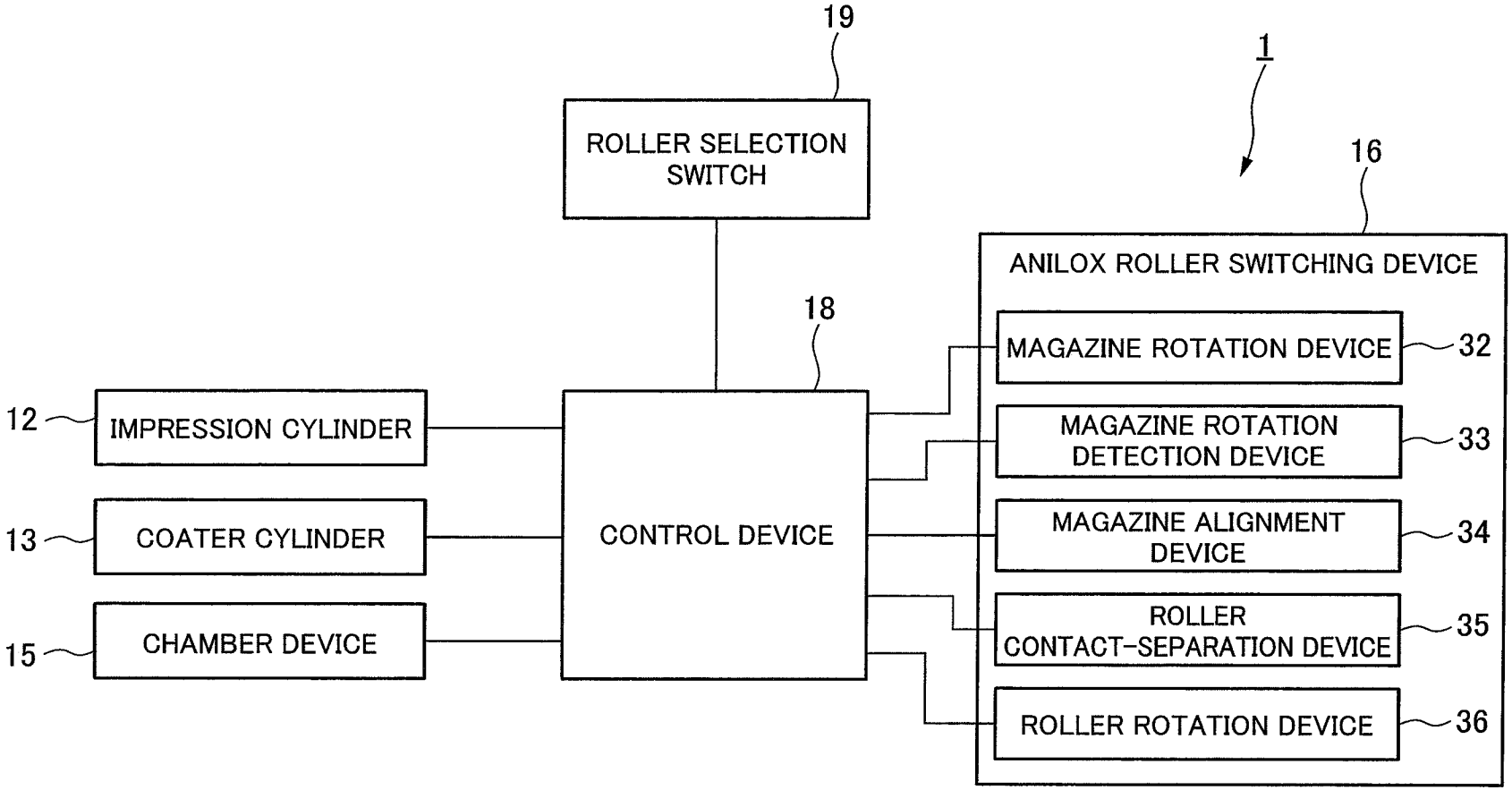
FIG. 10 is a block diagram illustrating a control device in the liquid transfer apparatus according to Embodiment 1.

As illustrated in FIG. 10, the coating apparatus 1 is provided with a control device 18 which controls operations of the coating apparatus 1. The control device is electrically connected to the impression cylinder 12 (including a not-illustrated impression cylinder drive device), the coater cylinder 13 (including a not-illustrated coater cylinder drive device), and the chamber device 15, and is also electrically connected to the magazine rotation device 32, the magazine rotation detection device 33, the magazine alignment device 34, the roller contact-separation device 35, and the roller rotation device 36 in the anilox roller switching device 16.

Moreover, the coating apparatus 1 is provided with a roller selection switch 19 which is operated by the worker, as a roller selection device (unit) used to select the anilox roller 14 to be used for the coating (to be disposed at the transfer operation position). The roller selection switch 19 is electrically connected to the control device 18 and the control device 18 controls a roller switching operation of the coating apparatus 1 based on a signal sent from the roller selection switch 19.

Operations of the coating apparatus according to the embodiment are described with reference to FIGS. 1 to 10.

In the coating apparatus 1, when the sheet held on the impression cylinder 12 passes a contact position between the impression cylinder 12 and the coater cylinder 13, the coating liquid supplied to the anilox roller 14 by the chamber device 15 is transferred to a surface of the sheet via the coater cylinder 13 (see FIG. 1).

This transfer operation of the coating apparatus 1 is performed in a state where a certain anilox roller 14 selected by the worker operating the roller selection switch 19 is in contact with the coater cylinder 13 (disposed at the contact position with the coater cylinder 13) at the transfer operation position and the chamber 121 is disposed at the liquid supply operation position (close to the anilox roller 14).

Next, when the content of printing performed on the sheet in the not-illustrated printing apparatus is changed, switching of the anilox roller 14 (roller switching operation of the coating apparatus 1) is performed as necessary. Specifically, in the coating apparatus 1, a certain anilox roller 14 corresponding to the printing content is selected based on a detection result of the roller selection switch 19 and the switching is performed such that the selected anilox roller 14 is brought into contact with the coater cylinder 13 at the transfer operation position.

As a matter of course, the present invention is not limited to the configuration which includes the roller selection switch 19 and in which the anilox roller 14 to be used for the coating is selected by the worker operating the roller selection switch as in the embodiment. The selection of the anilox roller 14 to be used for the coating may be automated.

Figure 12:
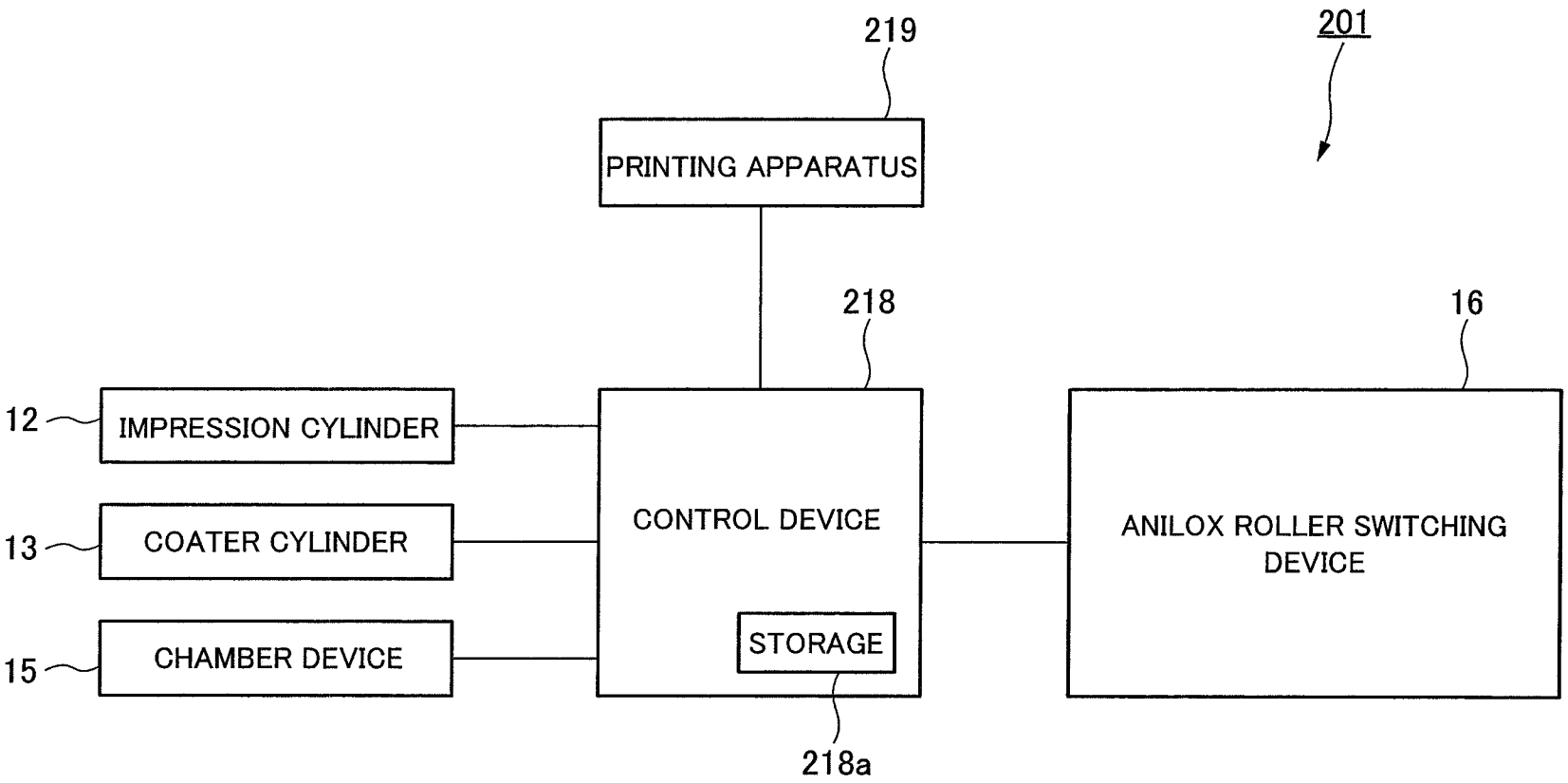
FIG. 12 is a block diagram illustrating an example in which roller switching is automated in the liquid transfer apparatus according to Embodiment 1.

For example, as illustrated in FIG. 12, the present invention may include, as a roller selection device which can be automated, a configuration in which a control device 218 and a printing apparatus 219 are electrically connected and a configuration (storage 218*a*) which stores contents of printing performed on the sheets and the anilox rollers selected for the sheets subjected to printing of the respective printing contents. In such a coating apparatus 201, the control device 218 controls operations of the anilox roller switching device 16 based on information (signal) on the printing content sent from the printing apparatus 219 and information stored in the storage 218*a*. Specifically, when the sheet subjected to the printing of the same printing content as any of the past printing contents is to be coated, the control device 218 performs the roller switching operation by selecting a certain anilox roller stored in the storage 218*a*.

Figure 13:
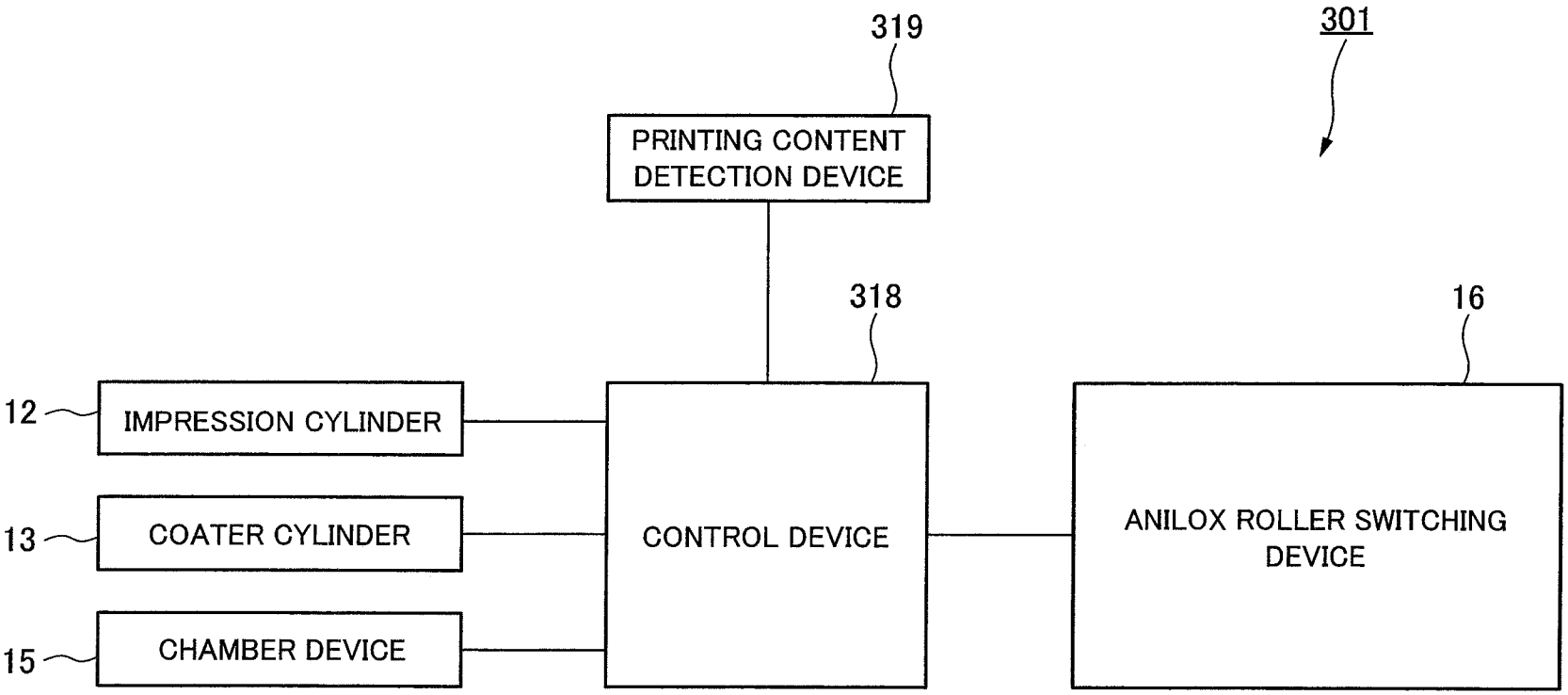
FIG. 13 is a block diagram illustrating an example in which the roller switching is automated in the liquid transfer apparatus according to Embodiment 1.

Moreover, for example, as illustrated in FIG. 13, a printing content detection device (camera) 319 which can read the printing content (picture information or the like) of the sheet may be provided as the roller selection device which can be automated. In such a coating apparatus 301, a control device 318 controls the operations of the anilox roller switching device 16 based on a detection result of the printing content detection device 319. Specifically, the control device 318 performs the roller switching operation by selecting an anilox roller appropriate for the printing content (picture information or the like) of the sheet detected by the printing content detection device 319.

The roller switching operation of the coating apparatus 1 is described below in detail.

First, the roller contact-separation device 35 is operated to move the anilox roller 14 currently at the transfer operation position from the contact position with the coater cylinder 13 to the separated position from the coater cylinder 13 (see FIGS. 2, 7, and 8). Specifically, the contact-separation rods 84*a* are driven by the contact-separation motors 84 to be moved in the axial direction (perform the contracting operation). The second connection members 83 are thereby rotated to one side (counterclockwise in FIG. 8) about the pin members 85 and the first connection members 82 are moved to one side in an almost axial direction (substantially upward in FIG. 8). The eccentric portions 81*b* of the eccentric bearings 81 are thereby rotated to one side (counterclockwise in FIG. 8) relative to the fixation portions 81*a*. The eccentric operation in the eccentric bearings 81 causes the roller magazine 31 to move in the direction orthogonal to the axial direction and the anilox roller 14 currently at the transfer operation position is moved from the contact position with the coater cylinder 13 to the separated position from the coater cylinder 13.

Next, the chamber device 15 is operated to move the chamber 121 from the liquid supply operation position to the retreat position (see FIGS. 1 and 10). In this case, the chamber detection device 125 detects that the chamber 121 is disposed at the retreat position (chamber 121 is not disposed at the liquid supply operation position), and the detection result is sent to the control device 18. Note that, when the aforementioned second chamber detection device (not illustrated) is provided, the chamber detection device 125 detects that the chamber 121 is disposed at the retreat position and the not-illustrated second chamber detection device detects that the chamber 121 is not disposed at the liquid supply operation position.

Next, the magazine alignment device 34 is operated to set the roller magazine 31, that is the anilox rollers 14 to a rotatable state (see FIGS. 1, 5, and 6). Specifically, the alignment cylinder 73 are contracted to cancel the engagement between the roller engagement member 72 and the alignment roller 71, that is the restriction on the rotating operation of the roller magazine 31, and the roller magazine 31 is set to the rotatable state.

In this case, the control device 18 controls operations of the magazine alignment device 34 (alignment cylinder 73) based on the detection result obtained by the chamber detection device 125 (see FIG. 10). Specifically, when the chamber device 125 detects that the chamber 121 is surely disposed at the retreat position, the magazine alignment device 34 (alignment cylinder 73) is operated. This control can surely avoid interference between the chamber device 15 (chamber 121) and a set of the roller magazine 31 and the anilox rollers 14 when the roller magazine 31 is rotationally driven.

Next, the magazine rotation device 32 is operated to move the selected anilox roller 14 to the transfer operation positon (see FIGS. 1 to 4). Specifically, the magazine rotation motor 57 is driven to rotate, and the roller magazine 31 is rotationally driven together with the magazine rotation gear 51 via the motor rotation gear 55, the second connection gear 54, and the first connection gear 52.

In this case, the control device 18 controls operations of the magazine rotation device 32 (magazine rotation motor 57) based on a detection result obtained by the magazine rotation detection device 33 (see FIG. 10). The magazine rotation detection device 33 (encoder 63) detects the rotating operation of the roller magazine 31 by the magazine rotation motor 57, that is the phase (position) of the anilox rollers 14 held by the roller magazine 31, and sends the detection result to the control device 18. Accordingly, the control device 18 can determine the moment when the phase of the roller magazine 31 reaches a certain phase, that is the selected anilox roller 14 is disposed at the transfer operation position, and can dispose the selected anilox roller 14 at the transfer operation position by stopping the rotation of the roller magazine 31 at the certain phase.

Next, the magazine alignment device 34 is operated to align the roller magazine 31, that is the anilox rollers 14 (see FIGS. 1, 5, and 6). Specifically, the alignment cylinder 73 is extended to cause the roller engagement member 72 to engage with the alignment roller 71, and the movement of the alignment roller 71 about the axis of rotation of the roller magazine 31 (in the circumferential direction), that is the rotating operation of the roller magazine 31 is thereby restricted at the certain rotation phase (the positions of the anilox rollers 14 are fixed).

Next, the chamber device 15 is operated to move the chamber 121 from the retreat position to the liquid supply operation position (see FIGS. 1 and 10). In this case, the chamber detection device 125 detects that the chamber 121 is disposed at the liquid supply operation position (chamber 121 is not disposed at the retreat position) and the detection result is sent to the control device 18. Note that, when the aforementioned second chamber detection device (not illustrated) is provided, the chamber detection device 125 detects that the chamber 121 is not disposed at the retreat position and the not-illustrated second chamber detection device detects that the chamber 121 is disposed at the liquid supply operation position.

Next, the roller contact-separation device 35 is operated to move the selected anilox roller 14 from the separated position from the coater cylinder 13 to the contact position with the coater cylinder 13 (see FIGS. 2, 7, and 8). Specifically, the contact-separation rods 84*a* are driven by the contact-separation motors 84 to be moved in the axial direction (perform the extending operation). The second connection members 83 are thereby rotated to the other side (clockwise in FIG. 8) about the pin members 85 and the first connection members 82 are moved to the other side in the almost axial direction (substantially downward in FIG. 8). The eccentric portions 81*b* of the eccentric bearings 81 are thereby rotated to the other side (clockwise in FIG. 8) relative to the fixation portions 81*a*. The eccentric operation in the eccentric bearings 81 causes the roller magazine 31 to move in the direction orthogonal to the axial direction and the selected anilox roller 14 is moved from the separated position from the coater cylinder 13 to the contact position with the coater cylinder 13.

In this case, the control device 18 controls operations of the roller contact-separation device 35 (contact-separation motors 84) based on the detection result obtained by the chamber detection device 125 (see FIG. 10). Specifically, when the chamber detection device 125 detects that the chamber 121 is disposed at the liquid supply operation position (chamber 121 is not disposed at the retreat position), the roller contact-separation device 35 (contact-separation motors 84) is operated. By this control, the anilox roller 14 is moved to the contact position with the coater cylinder 13 (brought into contact with the coater cylinder 13) while being sufficiently supplied with the coating liquid by the chamber device 15.

Moreover, the control device 18 controls operations of the roller contact-separation device 35 (contact-separation motors 84-1, 84-2) based on detection results obtained by the encoders 88-1, 88-2 (see FIGS. 7 and 10). Specifically, since the rotation phases of the contact-separation motors 84-1, 84-2 are detected by the encoders 88-1, 88-2, respectively, the control device 18 can accurately determine the movement amounts of the contact-separation rods 84*a*, that is the position (including tilt) of the anilox roller 14 and finely adjust the contact position and printing pressure of the anilox roller 14.

The operations described above establishes a state where the selected anilox roller 14 is in contact with the coater cylinder 13 (disposed at the contact position with the coater cylinder 13) at the transfer operation position and the chamber 121 is disposed at the liquid supply operation position (close to the anilox roller 14), and the transfer operation of the coating apparatus 1 corresponding to the printing content is performed.

Note that the anilox rollers 14 are rotationally driven by the roller linked rotation mechanism 94 of the roller rotation device 36 in the transfer operation of the coating apparatus 1, and are rotationally driven by the roller independent rotation mechanism 95 of the roller rotation device 36 in the roller switching operation of the coating apparatus 1.

In the transfer operation of the coating apparatus 1, the impression cylinder 12 (not-illustrated impression cylinder drive device) is rotationally driven at a higher speed than that of the roller independent rotation motor 117. Accordingly, the rotating operation of the impression cylinder 12 is transmitted to the anilox rollers 14 by the clutch mechanism 101*a* in the roller linked rotation gear 101 via the roller linked rotation mechanism 94, and the anilox rollers 14 are rotationally driven together with the impression cylinder 12 by the roller linked rotation mechanism 94. In this case, the rotating operation of the impression cylinder 12 (anilox rollers 14 rotationally driven by the roller linked rotation mechanism 94) is not transmitted to the roller independent rotation motor 117 by the clutch mechanism 112*a* in the first connection gear 112. Rotationally driving the anilox rollers 14 together with the impression cylinder 12 in the transfer operation of the coating apparatus 1 as described above enables easy phase matching with the not-illustrated printing apparatus and the like.

Meanwhile, the driving of the impression cylinder 12 is stopped in the roller switching operation of the coating apparatus 1. Accordingly, the anilox rollers 14 are rotationally driven by the roller independent rotation mechanism 95, independent of the impression cylinder 12. In this case, the rotating operation of the roller independent rotation motor 117 (anilox rollers 14 rotationally driven by the roller independent rotation mechanism 95) is not transmitted to the impression cylinder 12 by the clutch mechanism 101*a* in the roller linked rotation gear 101. Rotationally driving the anilox rollers 14 independent of the impression cylinder 12 in the roller switching operation of the coating apparatus 1 as described above allows rotational drive of the anilox rollers 14 in the case where the drive of the not-illustrated printing apparatus or the like is temporary stopped, and can prevent hardening of the coating liquid on the anilox rollers 14.

As a matter of course, the present invention is not limited to the configuration including the clutch mechanisms 101*a*, 112*a* formed of the one-way clutch mechanisms as in the embodiment. For example, the control device 18 may operate the clutch mechanism 101*a* in the roller linked rotation gear 101 and the clutch mechanism 112*a* in the first connection gear 112 to switch between the rotating operation of the anilox rollers 14 by the roller linked rotation mechanism 94 and the rotation operation of the anilox rollers 14 by the roller independent rotation mechanism 95.

Moreover, the present invention is not limited to the configuration in which all of the anilox rollers 14 held by the roller magazine 31 are always rotationally driven by the roller linked rotation mechanism 94 or the roller independent rotation mechanism 95 as in the embodiment. For example, clutch mechanisms may be provided respectively in the roller gears 91 of the multiple anilox rollers 14 to temporarily stop the rotating drive of a certain one or some of the anilox rollers 14 held by the anilox roller switching device 16.

In this configuration, it is possible to, for example, stop the rotation drive of the anilox roller 14 at the cleaning position and easily clean this anilox roller 14 during the transfer operation by the coating apparatus 1. Moreover, it is possible to, for example, stop the rotation drive of the anilox roller 14 at the replacement position and easily perform replacement of the anilox roller 14 to be described later during the transfer operation by the coating apparatus 1.

Next, when there is a request to replace any of the anilox rollers 14 held by the roller magazine 31 with another anilox roller, the replacement of the anilox roller 14 (roller replacement operation of the coating apparatus 1) is performed. The roller replacement operation of the coating apparatus 1 is described below in detail.

First, the roller contact-separation device 35, the chamber device 15, the magazine alignment device 34, and the magazine rotation device 32 are operated as in the aforementioned roller switching operation of the coating apparatus 1, and the anilox roller 14 to be replaced is moved to the replacement position (see FIGS. 1 to 9). Specifically, the anilox roller 14 held on the opposite side of the roller magazine 31 to the anilox roller 14 to be replaced is moved to the transfer operation position and is aligned (position thereof is fixed), and the anilox roller 14 to be replaced is thereby disposed at the replacement position (see FIG. 1).

Next, the anilox roller 14 at the replacement position is unloaded from the coating apparatus 1. Specifically, the worker opens the opening-closing door 132 of the housing 11, removes the fixation bolts 26 of the anilox roller 14 at the replacement position, and unloads the anilox roller 14 to the outside of the housing 11 by using the not-illustrated crane.

Next, the new anilox roller 14 is loaded into the coating apparatus 1. Specifically, the worker loads the new anilox roller 14 into the housing 11 by using the not-illustrated crane, aligns the anilox roller 14 with the roller magazine 31 by using the alignment pins 25, and fixes the anilox roller 14 to the roller magazine 31 by using the fixation bolts 26.

Since the replacement position of the anilox roller 14 is in an upper portion of the coating apparatus 1 in the vertical direction and the opening-closing door 132 is located above the anilox roller 14 at the replacement position in the vertical direction, a sufficient work space for the worker to load and unload the anilox roller 14 by using the crane is secured. Accordingly, the worker can easily perform the work of loading and unloading the anilox roller 14 by using the crane without bringing the anilox roller 14 into contact with peripheral members or the like.

The embodiment of the liquid transfer apparatus according to the present invention has been described above. In the embodiment, the roller magazine 31 forms a roller holding device configured to detachably hold the multiple rollers (anilox rollers 14) and perform the rotating operation to move any one of the multiple rollers to the predetermined position facing the blanket cylinder (coater cylinder 13), the roller contact-separation device 35 forms a contact-separation unit configured to bring the roller held by the roller holding device and disposed at the predetermined position into and out of contact with the blanket cylinder, the attachment portions 23, the pinholes 24, the alignment pins 25, the fixation bolts 26, the attachment grooves 43, and the pinholes 45 form an alignment unit configured to determine the position of each roller relative to the roller holding device, the magazine alignment device 34 forms a position fixation unit configured to fix the position of the roller held by the roller holding device and disposed at the predetermined position, and the roller contact-separation device 35 forms a printing pressure adjustment unit configured to adjust the printing pressure between the roller and the blanket cylinder. As a matter of course, the liquid transfer apparatus according to the present invention is not limited to that in the embodiment and various changes can be made within a scope not departing from the spirit of the present invention. For example, a scattering prevention device which prevents scattering of the coating liquid, a solvent, and the like in the coating apparatus may be additionally provided.

Figure 14A:
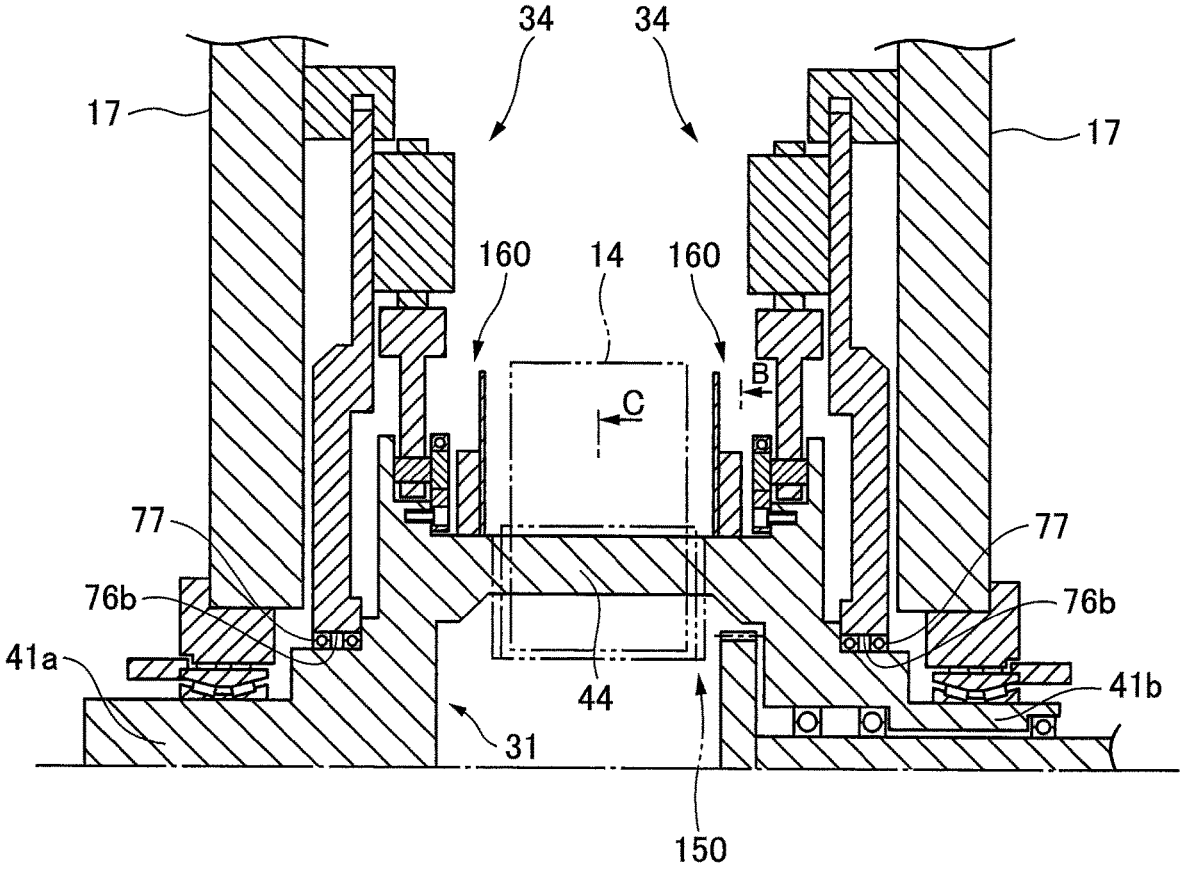
FIG. 14A is an explanatory view illustrating an example in which a scattering prevention device is additionally provided in the liquid transfer apparatus according to Embodiment 1 (corresponding to FIG. 5).
Figure 14B:
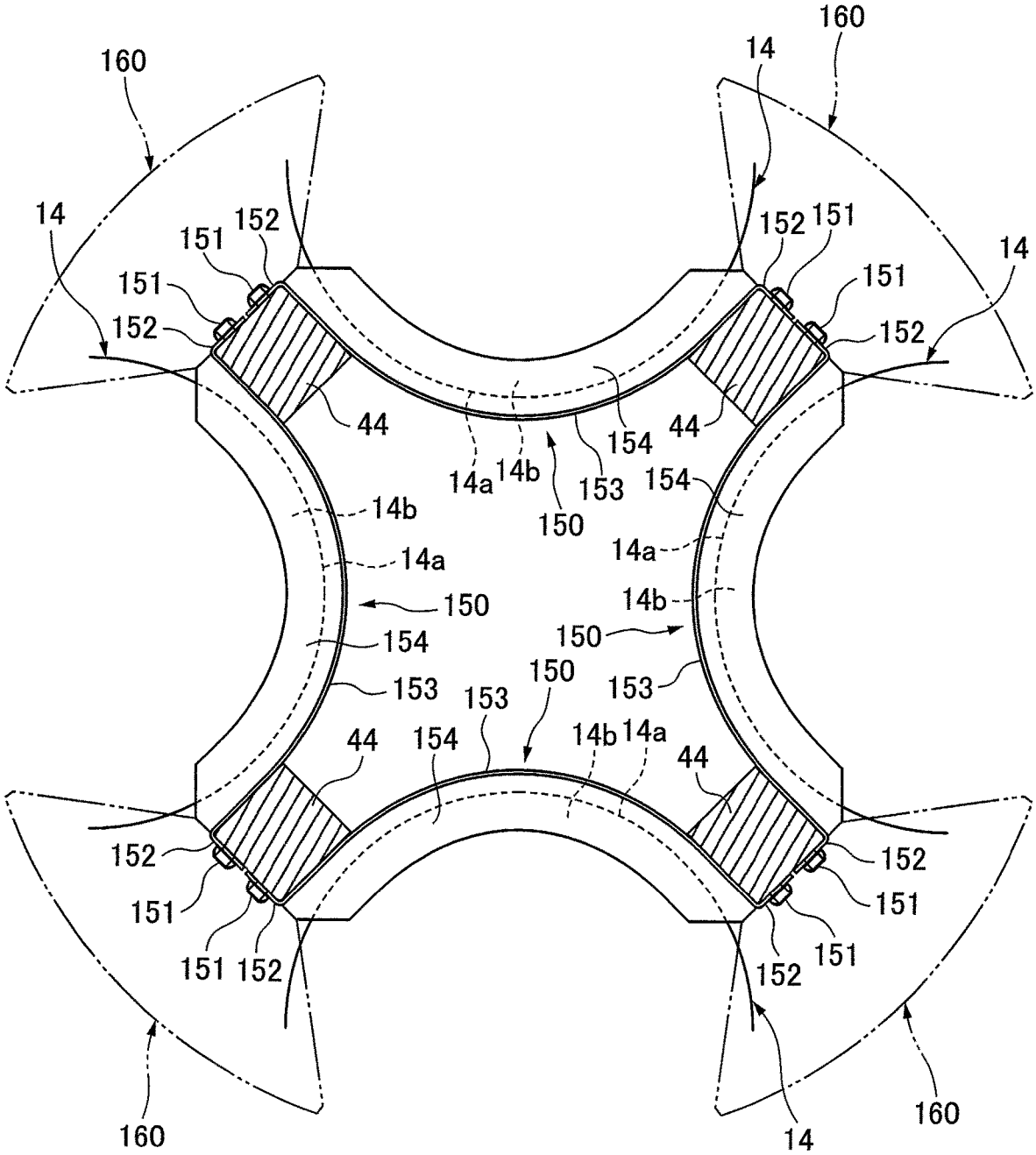
FIG. 14B is an explanatory view illustrating the example in which the scattering prevention device is additionally provided in the liquid transfer apparatus according to Embodiment 1 (view in the direction of the arrow B in FIG. 14A).
Figure 14C:
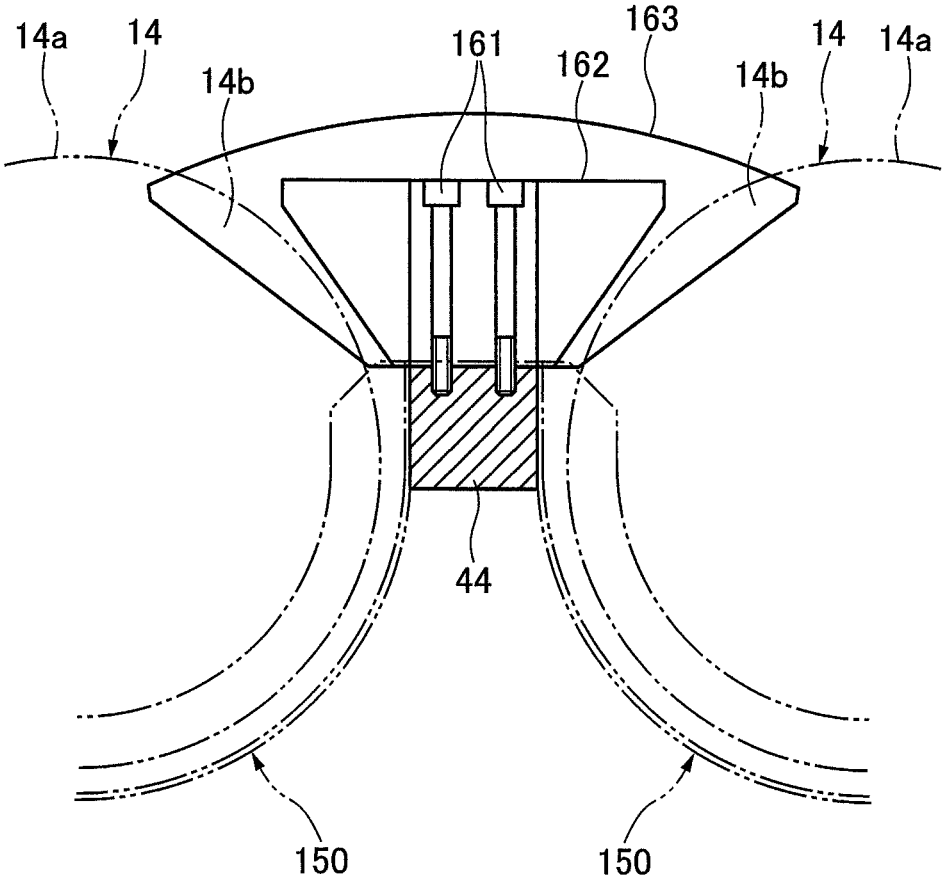
FIG. 14C is an explanatory view illustrating the example in which the scattering prevention device is additionally provided in the liquid transfer apparatus according to Embodiment 1 (view in the direction of the arrow C in FIG. 14A).

For example, as illustrated in FIGS. 14A to 14C, radial covers 150 which prevent scattering of liquid in the radial directions of the anilox rollers 14 held by the roller magazine 31 and axial covers 160 which prevent scattering of liquid in the axial directions of the anilox rollers 14 held by the roller magazine 31 may be provided as the scattering prevention device.

In this example, multiple (four in FIG. 14B which is the same as the number of the anilox rollers 14) radial covers 150 are provided in the circumferential direction of the roller magazine 31 and are each substantially formed of fixation portions 152 attached to the connection portions 44 by bolts 151, a peripheral surface portion 153 extending between the fixation portions 152 along a peripheral surface 14*a* of the corresponding anilox roller 14, and an end surface portion 154 partially covering an axial end surface 14*b* of the anilox roller 14. Specifically, the radial covers 150 are each formed to partially cover the peripheral surface 14*a* and the axial end surface 14*b* of the corresponding anilox roller 14 and are each attached over a region between the connection portions 44 adjacent to each other in the circumferential direction of the roller magazine 31.

Moreover, multiple (four in FIG. 14B which is the same as the number of the anilox rollers 14) axial covers 160 are provided in the circumferential direction of the roller magazine 31 and are each substantially formed of a fixation portion 162 which is attached to the connection portion 44 by bolts 161 and an end surface portion 163 which extends from the fixation portion 162 to partially cover the axial end surfaces 14*b* of the anilox rollers 14. Specifically, the axial covers 160 are each formed to partially cover a region between the corresponding anilox rollers 14 and the axial end surfaces 14*b* of the corresponding anilox rollers 14, and are each attached to the corresponding connection portion 44 of the roller magazine 31 to be located between the anilox rollers 14 adjacent to each other in the circumferential direction.

Providing the radial covers 150 as the scattering prevention device as described above can prevent the coating liquid, the solvent, and the like from scattering due to the rotating operation of the anilox rollers 14 and attaching to other anilox rollers 14 and the like. Moreover, providing the axial covers 160 as the scattering prevention device can prevent the coating liquid, the solvent, and the like from scattering due to the rotating operation of the anilox rollers 14 and attaching to other peripheral devices, peripheral members, and the like.

REFERENCE SIGNS LIST

1 COATING APPARATUS (LIQUID TRANSFER APPARATUS)
11 HOUSING
12 IMPRESSION CYLINDER
13 COATER CYLINDER (BLANKET CYLINDER)
14 ANILOX ROLLER (ENGRAVED CYLINDER, ROLLER)
15 CHAMBER DEVICE (LIQUID SUPPLY DEVICE)
16 ANILOX ROLLER SWITCHING DEVICE
17 FRAME
17A BEARING HOLE
18 CONTROL DEVICE
19 ROLLER SELECTION SWITCH (ROLLER SELECTION DEVICE)
21 CYLINDER PORTION
22 ROTARY SHAFT PORTION
23 ATTACHMENT PORTION (ALIGNMENT UNIT)
24 PIN HOLE (ALIGNMENT UNIT)
25 ALIGNMENT PIN (ALIGNMENT UNIT)
26 FIXATION BOLT (ALIGNMENT UNIT)

31 ROLLER MAGAZINE (ROLLER HOLDING DEVICE)
32 MAGAZINE ROTATION DEVICE
33 MAGAZINE ROTATION DETECTION DEVICE
34 MAGAZINE ALIGNMENT DEVICE (POSITION FIXATION UNIT)
35 ROLLER CONTACT-SEPARATION DEVICE (CONTACT-SEPARATION UNIT, PRINTING PRESSURE ADJUSTMENT UNIT)
36 ROLLER ROTATION DEVICE
41A, 41B ROTARY SHAFT PORTION
42 SIDE PLATE PORTION
43 ATTACHMENT GROOVE (ALIGNMENT UNIT)
44 CONNECTION PORTION
45 PIN HOLE (ALIGNMENT UNIT)
51 MAGAZINE ROTATION GEAR
52 FIRST CONNECTION GEAR
53 CONNECTION SHAFT
54 SECOND CONNECTION GEAR
55 MOTOR ROTATION GEAR
56 MOTOR ROTARY SHAFT
57 MAGAZINE ROTATION MOTOR
58 SUB-FRAME
61 FIRST CONNECTION GEAR
62 SECOND CONNECTION GEAR
63 ENCODER
64 SUB-FRAME
71 ALIGNMENT ROLLER
71A ROLLER MEMBER
71B ROLLER HOLDING MEMBER
71C MAIN BODY PORTION
71D SCREW MEMBER
72 ROLLER ENGAGEMENT MEMBER
72A ENGAGEMENT PORTION
72B SIDE SURFACE (GUIDE SURFACE)
73 ALIGNMENT CYLINDER
74 GUIDE ROLLER
74A ROLLER MEMBER
74B ROLLER HOLDING MEMBER
74C MAIN BODY PORTION
74D SCREW MEMBER
75 PIN MEMBER
76 SUB-FRAME
76A PIN HOLE
76B INSERTION HOLE
77 BEARING
81 ECCENTRIC BEARING
81A FIXATION PORTION
81B ECCENTRIC PORTION
81C ROTATION PORTION
82 FIRST CONNECTION MEMBER
83 SECOND CONNECTION MEMBER
84 CONTACT-SEPARATION CYLINDER
84A CONTACT-SEPARATION ROD
85 PIN MEMBER
86 PIN MEMBER
87 SUB-FRAME
88-1, 88-2 ENCODER
91 ROLLER GEAR
92 ROLLER ROTATION GEAR
93 ROLLER ROTATION GEAR SHAFT
94 ROLLER LINKED ROTATION MECHANISM
95 ROLLER INDEPENDENT ROTATION MECHANISM
101 ROLLER LINKED ROTATION GEAR
101A CLUTCH MECHANISM
102 FIRST CONNECTION GEAR
103 SECOND CONNECTION GEAR
104 THIRD CONNECTION GEAR
105 IMPRESSION CYLINDER DRIVE GEAR
111 ROLLER INDEPENDENT ROTATION GEAR
112 FIRST CONNECTION GEAR
112A CLUTCH MECHANISM
113 CONNECTION SHAFT
114 SECOND CONNECTION GEAR
115 MOTOR ROTATION GEAR
116 MOTOR ROTARY SHAFT
117 ROLLER INDEPENDENT ROTATION MOTOR
118 SUB-FRAME
119 SUB-FRAME
121 CHAMBER
122 HOLDING LEVER
123 PIN MEMBER
124 ATTACHMENT PLATE
125 CHAMBER DETECTION DEVICE
131 OPENING PORTION
132 OPENING-CLOSING DOOR
133 OPENING PORTION
134 OPENING-CLOSING DOOR
135 OPENING PORTION
136 OPENING-CLOSING DOOR

The invention claimed is:

1. A liquid transfer apparatus comprising:
rollers configured to transfer supplied liquid to a blanket cylinder;
a roller holding device configured to detachably hold the rollers and perform a rotating operation to move any one of the rollers to a predetermined position facing the blanket cylinder;
a contact-separation unit configured to bring the roller held by the roller holding device and disposed at the predetermined position into and out of contact with the blanket cylinder; and
a position fixation unit configured to fix a position of the roller held by the roller holding device and disposed at the predetermined position, wherein
the position fixation unit includes:
an alignment roller fixed to the roller holding device;
a roller engagement member capable of engaging with the alignment roller; and
an alignment cylinder configured to move the roller engagement member toward and away from the alignment roller,
the alignment cylinder of the position fixation unit is fixed to a sub-frame pin-connected to a frame via a pin member; and
a guide roller provided in the position fixation unit and configured to guide the roller engagement member when the alignment cylinder of the position fixation unit performs extending and contracting operations.

2. The liquid transfer apparatus according to claim 1, comprising an alignment unit configured to determine positions of the rollers relative to the roller holding device.

3. The liquid transfer apparatus according to claim 1, comprising a printing pressure adjustment unit configured to adjust printing pressure between the blanket cylinder and each of the rollers being at the predetermined position.

4. The liquid transfer apparatus according to claim 1, wherein the guide roller includes an eccentric mechanism configured to guide the roller engagement member by coming into contact therewith and adjust a position of the roller engagement member to correspond to a position of the alignment roller of the position fixation unit.

5. The liquid transfer apparatus according to claim 1, wherein the alignment roller of the position fixation unit includes an eccentric mechanism configured to adjust the position of the roller held by the roller holding device.

6. The liquid transfer apparatus according to claim 1, wherein the alignment rollers of the position fixation unit as many as the rollers held by the roller holding device are provided in the roller holding device.

* * * * *